US009528531B2

(12) United States Patent
Sugano et al.

(10) Patent No.: US 9,528,531 B2
(45) Date of Patent: Dec. 27, 2016

(54) HYDRAULIC DRIVE APPARATUS FOR WORK MACHINE

(71) Applicants: Kobe Steel, Ltd., Kobe-shi (JP); KOBELCO CRANES CO., LTD., Shinagawa-ku (JP)

(72) Inventors: Naoki Sugano, Kobe (JP); Naoto Hori, Akashi (JP); Takaharu Michida, Akashi (JP)

(73) Assignees: Kobe Steel, Ltd., Kobe-shi (JP); KOBELCO CRANES CO., LTD., Shinagawa-ku (JP)

( * ) Notice: Subject to any disclaimer, the term of this patent is extended or adjusted under 35 U.S.C. 154(b) by 268 days.

(21) Appl. No.: 14/077,532

(22) Filed: Nov. 12, 2013

(65) Prior Publication Data

US 2014/0130486 A1 May 15, 2014

(30) Foreign Application Priority Data

Nov. 13, 2012 (JP) ..... 2012-249063

(51) Int. Cl.
*F15B 15/02* (2006.01)
*F15B 11/044* (2006.01)
*F15B 11/042* (2006.01)

(52) U.S. Cl.
CPC ..... *F15B 11/044* (2013.01); *F15B 11/042* (2013.01); *F15B 2211/30525* (2013.01);
(Continued)

(58) Field of Classification Search
CPC ..... F15B 21/14; F15B 2211/6346; F15B 2211/88; F15B 11/044; F15B 11/042; E02F 9/2282; E02F 9/2217; E02F 9/2228; E02F 9/2285
See application file for complete search history.

(56) References Cited

U.S. PATENT DOCUMENTS 3,895,564 A 7/1975 Pinson
5,460,001 A 10/1995 Kato et al.
(Continued)

FOREIGN PATENT DOCUMENTS

CN 2072546 U 3/1991
CN 102086796 A 6/2011
(Continued)

OTHER PUBLICATIONS

Combined Office Action and Search Report issued Aug. 28, 2015 in Chinese Patent Application No. 201310571882.2 (with partial English language translation and English translation of categories of cited documents).
(Continued)

*Primary Examiner* — F. Daniel Lopez
*Assistant Examiner* — Richard Drake
(74) *Attorney, Agent, or Firm* — Oblon, McClelland, Maier & Neustadt, L.L.P.

(57) ABSTRACT

Provided is a hydraulic drive apparatus for working machine capable of preventing an excessive pressure drop on a meter-in side and moving a load in a lowering direction at a stable speed requiring no counter balance valve, including a hydraulic pump, a first hydraulic actuator lowering a first load, an operating device, a first hydraulic circuit including meter-in and meter-out flow passages, a control valve, a meter-in-flow-rate controller, a meter-out-flow-rate controller making a meter-out flow rate not lower than a meter-in flow rate, a second hydraulic actuator, a second hydraulic circuit between the first hydraulic circuit and a tank and for the second hydraulic actuator, a back pressure valve between the second hydraulic circuit and the tank, a regeneration line leading a part of hydraulic fluid from between the second hydraulic circuit and the back pressure valve to the meter-in flow passage, and a check valve in the regeneration line.

4 Claims, 11 Drawing Sheets

(52) U.S. Cl.
CPC .. *F15B 2211/3116* (2013.01); *F15B 2211/351* (2013.01); *F15B 2211/40569* (2013.01); *F15B 2211/41527* (2013.01); *F15B 2211/45* (2013.01); *F15B 2211/46* (2013.01); *F15B 2211/50545* (2013.01); *F15B 2211/5156* (2013.01); *F15B 2211/7058* (2013.01); *F15B 2211/761* (2013.01); *F15B 2211/8609* (2013.01)

(56) References Cited

U.S. PATENT DOCUMENTS

| | | | | |
|---|---|---|---|---|
| 6,050,090 | A | 4/2000 | Tohji | |
| 6,389,953 | B1 | 5/2002 | Altman | |
| 6,467,264 | B1 * | 10/2002 | Stephenson | F15B 11/006 60/368 |
| 6,837,140 | B2 | 1/2005 | Oka et al. | |
| 7,392,653 | B2 | 7/2008 | Sugano | |
| 7,444,809 | B2 * | 11/2008 | Smith | E02F 9/2217 60/413 |
| 7,451,685 | B2 | 11/2008 | Tabor | |
| 7,905,088 | B2 * | 3/2011 | Stephenson | E02F 9/2217 60/414 |
| 9,187,297 | B2 * | 11/2015 | Sugano | B66D 1/44 |
| 2005/0011190 | A1 | 1/2005 | Bitter | |
| 2009/0288408 | A1 * | 11/2009 | Tozawa | E02F 9/2075 60/435 |
| 2009/0308068 | A1 | 12/2009 | Yoshino | |
| 2012/0233997 | A1 * | 9/2012 | Andruch, III | E02F 9/2217 60/428 |
| 2012/0285159 | A1 * | 11/2012 | Sugano | B66D 1/44 60/470 |
| 2013/0199170 | A1 * | 8/2013 | Neumann | B66F 9/22 60/384 |

FOREIGN PATENT DOCUMENTS

| | | | |
|---|---|---|---|
| CN | 102695884 | A | 9/2012 |
| JP | 59-199199 | A | 11/1984 |
| JP | 2000-310201 | | 11/2000 |
| JP | 3968911 | B2 | 8/2007 |
| JP | 2009-150462 | A | 7/2009 |

OTHER PUBLICATIONS

Office Action mailed Nov. 20, 2015, in co-pending U.S. Appl. No. 14/077,508.
Office Action issued in corresponding U.S. Appl. No. 14/077,508 dated May 6, 2016.

* cited by examiner

HYDRAULIC DRIVE APPARATUS FOR WORK MACHINE

BACKGROUND OF THE INVENTION

Technical Field

The present invention relates to a hydraulic drive apparatus for moving a load such as a suspended load in the same direction as a self-weight falling direction, in which the load falls by its own weight, in a working machine such as a crane.

Description of the Background Art

As an apparatus for moving a load in the same direction as its self-weight falling direction, there is known a lowering drive apparatus for driving, for example, a winch for hanging a suspended load by a wire in a lowering direction. In this apparatus, it is important to prevent the suspended load from falling down due to stall resulting from a drop in meter-in side pressure which causes cavitation during lowering drive.

As a means for preventing such a drop in the meter-in side pressure, it is disclosed in Japanese Unexamined Patent Publication No. 2000-310201 to provide so-called an external-pilot-controlled counter balance valve in a meter-out side flow passage. This external-pilot-controlled counter balance valve is operated to choke the meter-out side flow passage when the meter-in side pressure falls to or below a set pressure, thereby preventing the meter-in side pressure from excessive drop.

The control by the external-pilot-controlled counter balance valve, however, has a problem of being inherently unstable and prone to hunting, because respective positions of the measurement point and the control point are different from each other, specifically, having its pressure measurement point on the meter-in side while having its pressure control point on the meter-out side; thus, so-called co-location is not present in control theory.

To prevent the hunting, there can be provided such an orifice as to apply considerable damping to a valve opening operation of the counter balance valve in a pilot fluid passage; however, this orifice extends a valve opening time of the counter balance valve to thereby degrade the responsiveness of the counter balance valve. Furthermore, the orifice generates large orifice resistance in the counter balance valve until the full open of the valve, thus generating an unnecessary boost pressure.

To prevent the hunting, the above Japanese Unexamined Patent Publication No. 2000-310201 also discloses a communicating valve for allowing communication between the meter-in side flow passage and the meter-out side flow passage and a flow rate regulating valve for controlling a meter-in flow rate so as to decrease a differential pressure between the both flow passages; however, this technique involves a difficulty of obtaining a stable lowering speed. Specifically, in a general lowering control circuit, there occurs a holding pressure corresponding to the weight of a suspended load at the meter-out side, which increases a differential pressure between the meter-in side and the meter-out side with an increase in the weight of the suspended load. This increase in the differential pressure involves an increase in the opening of the flow rate regulating valve on the meter-in side, thereby increasing the meter-in flow rate. Thus, in this apparatus, the lowering speed is largely varied depending on the weight of the load.

On the other hand, there can be cases where a hydraulic actuator for moving a load in a lowering direction such as during the lowering drive is required to be arranged with another hydraulic actuator in series between a hydraulic pump and a tank to thus allow these hydraulic actuators to be driven by the common hydraulic pump.

SUMMARY OF THE INVENTION

An object of the present invention is to provide a hydraulic drive apparatus for working machine capable of preventing pressure on a meter-in side from excessive drop while not involving hunting or generation of a large boost pressure, which are drawbacks of a conventional counter balance valve, and capable of moving a load in a lowering direction, which is the same direction as a self-weight falling direction in which the load falls by its own weight, at a stable speed, while connecting a hydraulic actuator for moving the load in the lowering direction and another hydraulic actuator in series to a common hydraulic pump to drive these actuators.

A hydraulic drive apparatus for work machine provided by the present invention includes: a hydraulic pump; a drive source for driving this hydraulic pump to make the hydraulic pump discharge hydraulic fluid; a first hydraulic actuator which includes an inlet port and an outlet port and is operated to move the load in the lowering direction by receiving the supply of the hydraulic fluid discharged from the hydraulic pump through the inlet port and discharging the hydraulic fluid through the outlet port; a first hydraulic circuit including a meter-in flow passage for introducing the hydraulic fluid to the inlet port of the first hydraulic actuator from the hydraulic pump in moving the load in the lowering direction and a meter-out flow passage for leading the hydraulic fluid discharged from the outlet port of the first hydraulic actuator to a downstream side in moving the load in the lowering direction; a control valve which is operated to change a supply state of the hydraulic fluid from the hydraulic pump to the first hydraulic actuator; an operating device for operating the control valve; a meter-in-flow-rate controller for controlling a meter-in flow rate which is a flow rate of the hydraulic fluid in the meter-in flow passage; a meter-out-flow-rate controller for controlling a meter-out flow rate, which is a flow rate of the hydraulic fluid in the meter-out flow passage, so as to make the meter-out flow rate not lower than the meter-in flow rate controlled by the meter-in-flow-rate controller; a second hydraulic actuator other than the first hydraulic actuator; a second hydraulic circuit interposed between the first hydraulic circuit and a tank to introduce the hydraulic fluid flowed in the first hydraulic circuit to the second hydraulic actuator to drive the second hydraulic actuator and lead the hydraulic fluid discharged from the second hydraulic actuator to the tank; a back pressure valve provided between the second hydraulic circuit and the tank to generate a set back pressure; a regeneration line branched off from a flow passage between the second hydraulic circuit and the back pressure valve and arranged to lead a part of the hydraulic fluid flowed to the back pressure valve to the meter-in flow passage; and a check valve provided in the regeneration line to limit a direction of the flow of the hydraulic fluid in the regeneration line to a direction from a position downstream of the second hydraulic circuit to the meter-in flow passage.

EMBODIMENTS OF THE INVENTION

A first embodiment of the present invention is described with reference to FIGS. 1 to 4.

Figure 1:
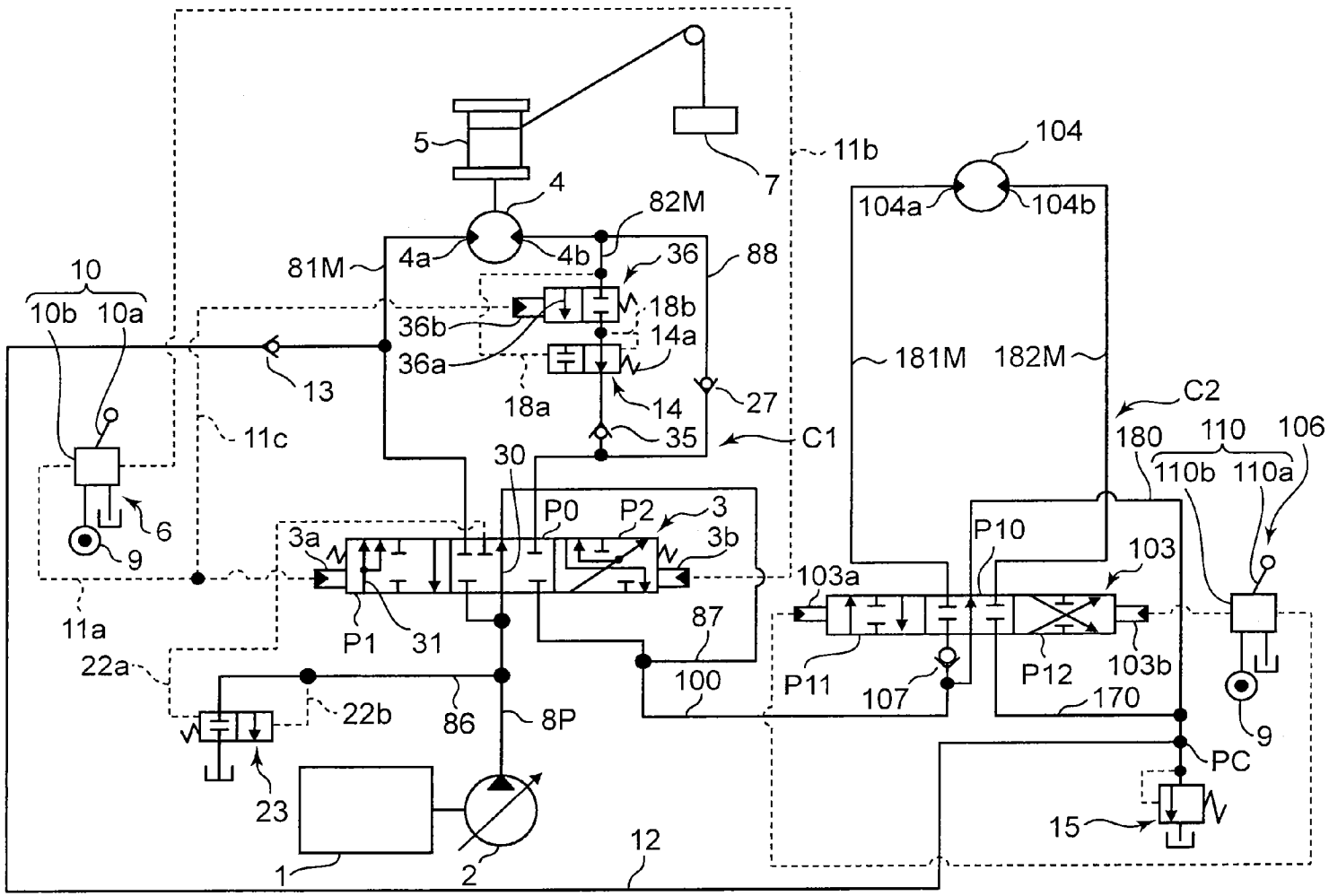
FIG. 1 is a circuit diagram showing a hydraulic drive apparatus for working machine according to a first embodiment of the present invention.

FIG. 1 is a circuit diagram showing the overall configuration of a hydraulic drive apparatus according to the first embodiment. This apparatus includes an engine 1, a hydraulic pump 2, a first hydraulic motor 4 as a first hydraulic actuator, a first hydraulic circuit C1 for driving the first hydraulic motor 4, a first operating device 6 for an operation on the rotation speed of the first hydraulic motor 4, a first control valve 3 for switching an fluid passage of the first hydraulic circuit C1, a meter-out-flow-rate controller, a meter-in-flow-rate controller, a second hydraulic motor 104 as a second hydraulic actuator, a second hydraulic circuit C2 for driving the second hydraulic motor 104, a second operating device 106 for an operation on the rotation speed of the second hydraulic motor 104, a second control valve 103 for switching an fluid passage of the second hydraulic circuit C2, a connection line 100 for interconnecting the first and second hydraulic circuits C1, C2 in series, a tank line 180 for connecting the second hydraulic circuit C2 to a tank T, a back pressure valve 15 provided in the tank line 180, a regeneration line 12, and a check valve 13 provided in the regeneration line 12.

The engine 1 is a power source of the hydraulic pump 2. The hydraulic pump 2 is driven by the engine 1 to thereby discharge hydraulic fluid in the tank. In this embodiment, a variable-displacement type hydraulic pump is used as the hydraulic pump 2.

The first hydraulic motor 4 is an example of a first hydraulic actuator according to the present invention and incorporated into a winch device including a winch drum 5, and rotates a winch drum 5 in both forward and reverse directions to hoist and lower a suspended load 7. Specifically, the first hydraulic motor 4 includes an A-port (that is, inlet port for lowering drive) 4*a* and a B-port (that is, outlet port for lowering drive) 4*b*, and is adapted: to rotate the winch drum 5 in a lowering direction, i.e., in a direction to lower the suspended load 7, and discharge the hydraulic fluid through the B-port 4*b* when the hydraulic fluid is supplied to the A-port 4*a*; and to rotate the winch drum 5 in a hoisting direction, i.e., in a direction to hoist the suspended load 7, and discharge the hydraulic fluid through the A-port 4*a* when the hydraulic fluid is supplied to the B-port 4*b*.

The first hydraulic circuit, which is provided to supply and discharge the hydraulic fluid discharged from the hydraulic pump 2 to and from the first hydraulic motor 4, includes as lines (pipes) for forming this circuit: a pump line 8P interconnecting a discharge port of the hydraulic pump 2 and the first control valve 3, a first motor line 81M interconnecting the first control valve 3 and the A-port 4*a* of the first hydraulic motor 4, a second motor line 82M interconnecting the first control valve 3 and the B-port 4*b* of the first hydraulic motor 4, a bypass line 88 provided in parallel with this second motor line 82M, an auxiliary connection line 87 interconnecting the first control valve 3 and the connection line 100, and a bleed-off line 86 branched off from the pump line 8P and reaching the tank.

The first control valve 3 is interposed between the hydraulic pump 2 and the first hydraulic motor 4 to switch a driving state of the winch drum 5 between a hoisting drive state and a lowering drive state according to an operation applied to the first operating device 6. The first control valve 3 according to this embodiment is configured by a three-position pilot-controlled selector valve including a lowering pilot port 3*a* and a hoisting pilot port 3*b* and operated: to be held at a neutral position P0 when no pilot pressure is supplied to either of the pilot ports 3*a*, 3*b*; to be shifted from the neutral position P0 toward a lowering drive position P1 to be opened by a stroke corresponding to the pilot pressure supplied to the lowering pilot port 3*a*; and is shifted from the neutral position P0 to a hoisting drive position P2 to be opened by a stroke corresponding to the pilot pressure supplied to the hoisting pilot port 3*b*.

The first control valve 3 forms the following flow passages at the above respective positions.

i) At the neutral position P0, the first control valve 3 prevents the hydraulic fluid discharged from the hydraulic pump 2 to be supplied to the first hydraulic motor 4 and forms a first bleed-off flow passage for leading the hydraulic fluid to the connection line 100 through the auxiliary connection line 87. The first control valve 3 further includes a bleed-off orifice 30 for specifying a bleed-off flow rate at this neutral position P0 and the bleed-off orifice 30 has an opening area Abo which is decreased with a distance from the neutral position P0.

ii) At the lowering drive position P1, the first control valve 3 connects the pump line 8P to the first motor line 81M to thereby open a flow passage for leading the hydraulic fluid discharged from the hydraulic pump 2 to the A-port 4*a* of the first hydraulic motor 4, namely, a "meter-in flow passage" for lowering drive, and connects the second motor line 82M to the connection line 100 to open a flow passage for flowing the hydraulic fluid discharged from the B-port 4*b* of the first hydraulic motor 4, namely, a "meter-out flow passage" for lowering drive. This meter-out flow passage is connected to the second hydraulic circuit C2 through the connection line 100. At this lowering drive position P1, the first control valve 3 further includes a meter-in orifice 31 for specifying a meter-in flow rate, which is a flow rate of the hydraulic fluid in the meter-in flow passage, and the meter-in orifice 31 has an opening area Ami which is increased with an increase in the stroke from the neutral position P0.

iii) At the hoisting drive position P2, the first control valve 3 connects the pump line 8P to the second motor line 82M and the bypass line 88 provided in parallel with the second motor line 82M to thereby form a flow passage for leading the hydraulic fluid discharged from the hydraulic pump 2 to the B-port 4*b* of the first hydraulic motor 4 (exclusively through the bypass line 88 as described later) and connects the first motor line 81M to the connection line 100 to thereby form a flow passage for flowing the hydraulic fluid discharged from the A-port 4*a* of the first hydraulic motor 4 to the second hydraulic circuit C2.

The first operating device 6 includes a pilot fluid pressure source 9, a remote-controlled valve 10, a lowering drive pilot line 11*a* and a hoisting drive pilot line 11*b*.

The remote-controlled valve 10, which is interposed between the pilot fluid pressure source 9 and the respective pilot ports 3*a*, 3*b* of the first control valve 3, includes an operation lever 10*a* to which an operation by an operator is applied and a valve main body 10*b* coupled to the operation lever 10*a*.

The valve main body 10*b* includes a lowering-drive output port and a hoisting-drive output port, and these output ports are connected to the both pilot ports 3*a*, 3*b* of the first control valve 3 through the lowering drive pilot line 11*a* and the hoisting drive pilot line 11*b*, respectively. This valve main body 10*b* is operated in tandem with the operation lever 10*a* so as to output a pilot pressure of a magnitude corresponding to the operation amount of the operation lever 10*a*, that is, the amount of the operation applied to the operation lever 10*a*, from the output port corresponding to a direction of the operation applied to the operation lever 10*a*, out of the both output ports, and input the pilot pressure to the pilot port corresponding to the output port out of the both pilot ports 3*a*, 3*b* of the first control valve 3.

Figure 2:
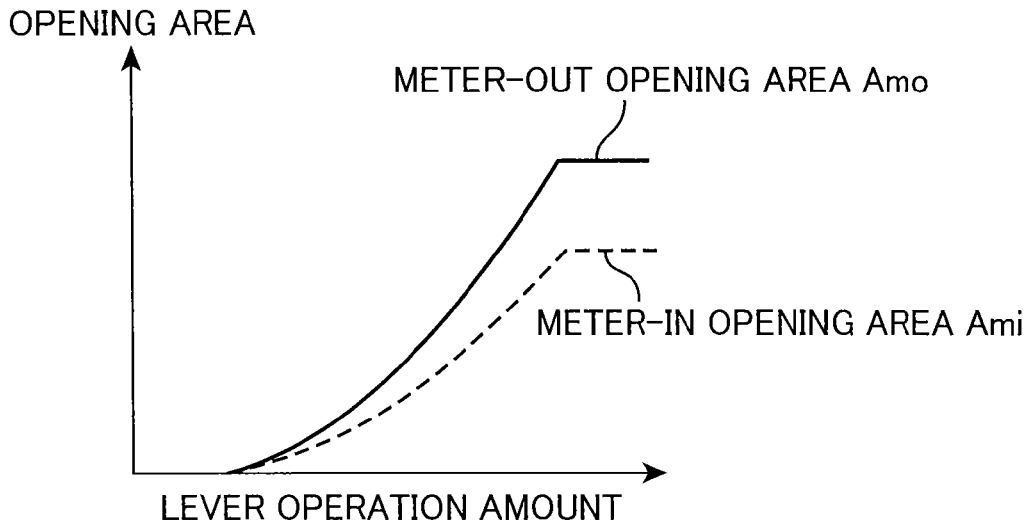
FIG. 2 is a graph showing a relationship between a lever operation amount of a remote-control valve of the apparatus shown in FIG. 1 and respective opening areas of a meter-out orifice in a meter-out-flow-rate controller and a meter-in orifice in a meter-in-flow-rate controller.
Figure 4:
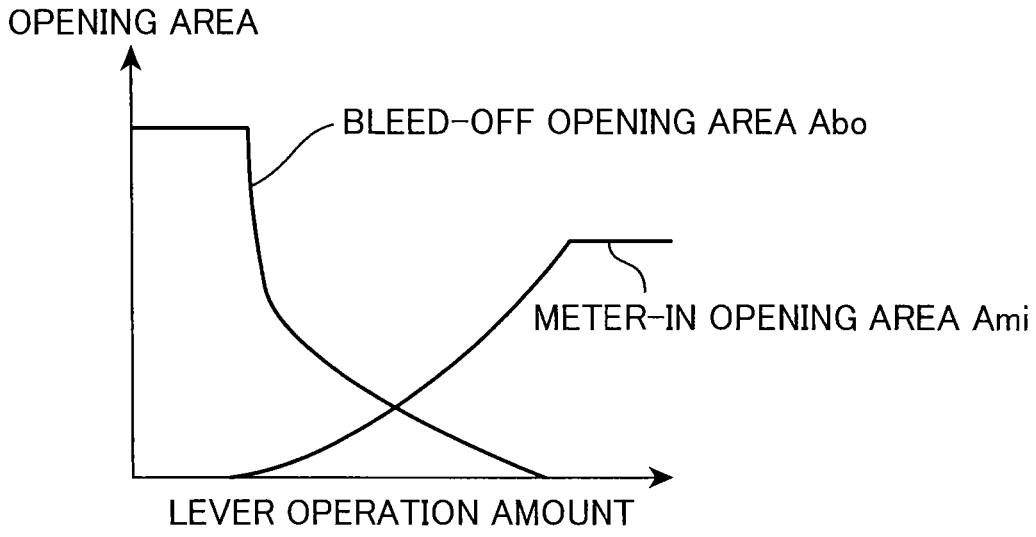
FIG. 4 is a graph showing a relationship between the lever operation amount and respective opening areas of a bleed-off orifice and the meter-in orifice.

As described above, the stroke of the first control valve 3 from its neutral position P0 to its lowering drive position P1 or its hoisting drive position P2 is increased with the magnitude of the input pilot pressure; this allows the operator to change the operating direction and the stroke of the first control valve 3 by applying an operation to the operation lever 10*a* and thereby vary the opening areas Abo, Ami of respective bleed-off orifice 30 and meter-in orifice 31. FIG. 2 shows a relationship between the operation amount of the operation lever 10*a* (in the lowering direction) and the opening area Ami of the meter-in orifice 31 by a broken line thereof and FIG. 4 shows a relationship between the operation amount and the opening areas Abo, Ami of respective bleed-off orifice 30 and meter-in orifice 31.

The meter-in-flow-rate controller, in this embodiment, includes the meter-in orifice 31 and a meter-in-flow-rate regulating valve 23 provided in the bleed-off line 86. The meter-in-flow-rate regulating valve 23 is capable of being opened and closed to vary a flow rate of a second bleed-off flow passage formed by the bleed-off line 86, having an opening degree which is varied so as to make a difference between respective pressures upstream of and downstream of the meter-in orifice 31, i.e., a differential pressure across the meter-in orifice 31, be a predetermined set differential pressure. Specifically, upon the increase in the differential pressure across the meter-in orifice 31, the meter-in-flow-rate regulating valve 23 is operated in a valve opening direction to increase the flow rate in the bleed-off line 86, thereby suppressing the meter-in flow rate. In this embodiment, there are produced an outlet-side pressure of the first control valve 3 at the lowering drive position P1, i.e., a pressure downstream of the meter-in orifice 31, and an inlet-side pressure of the meter-in-flow-rate regulating valve 23, i.e., a pump pressure as a pressure upstream of the meter-in orifice 31, into the meter-in-flow-rate regulating valve 23 from opposite sides through respective pressure introducing lines 22*a* and 22*b*, and the balance of the both pressures determines the opening area of the meter-in-flow-rate regulating valve 23 and a bleed-off flow rate corresponding thereto.

The meter-out-flow-rate controller is to control a meter-out flow rate, which is a flow rate of the hydraulic fluid in the meter-out flow passage, in accordance with an operation amount of the first operating device 6 in a lowering driving direction, specifically, the amount of the operation in the lowering driving direction applied to the operation lever 10*a* of the remote-control valve 10, namely, a lever operation amount; in this embodiment, the meter-out-flow-rate controller includes a meter-out orifice valve 36 and a meter-out-flow-rate regulating valve 14 provided in the second motor line 82M.

The meter-out orifice valve 36 includes an orifice 36*a* having a variable opening area and a pilot port 36*b*. The lowering-drive pilot pressure is input to the pilot port 36*b* through a branch line 11*c* which is branched off from the lowering drive pilot line 11*a*. Thus, the branch line 11*c* and a part of the lowering drive pilot line 11*a* upstream of a branching point of the branch line 11*c* constitute a meter-out pilot line for introducing the lowering-drive pilot pressure to the pilot port 36*b*. The meter-out orifice valve 36 has such an opening characteristic that the opening area of the orifice 36*a* is increased with an increase in the lowering-drive pilot pressure introduced to the pilot port 36*b*, i.e., with an increase in the operation amount of the operation lever 10*a* of the remote-control valve 10 in the lowering driving direction, while the opening area is kept minimum (preferably 0) when the operation amount is 0.

The meter-out-flow-rate regulating valve 14 is disposed, together with the meter-out orifice valve 36, in the second motor line 82M and operated to be opened or closed to make the differential pressure across the meter-out orifice valve 36, i.e., the difference between the pressures upstream of and downstream of the meter-out orifice valve 36, be a predetermined set differential pressure. Specifically, the meter-out-flow-rate regulating valve 14 includes a valve main body capable of being opened and closed and a spring 14*a* for biasing the valve main body in a valve opening direction; the pressure upstream of the meter-out orifice valve 36 is introduced to the meter-out-flow-rate regulating valve 14 through a pressure introducing line 18*a* from a side opposite to the spring 14*a*, while the pressure downstream of the meter-out orifice valve 36 is introduced to the meter-out-flow-rate regulating valve 14 through a pressure introducing line 18*b* from the same side as the spring 14*a*. Thus, the set differential pressure specified by the spring 14*a* and the difference between the upstream side pressure and the downstream side pressure determine an opening degree of the meter-out-flow-rate regulating valve 14*a* and a meter-out flow rate corresponding thereto. This meter-out-flow-rate regulating valve 14 may be provided downstream of the meter-out orifice valve 36 as shown in FIG. 1 or, conversely, may be provided upstream thereof.

Figure 3:
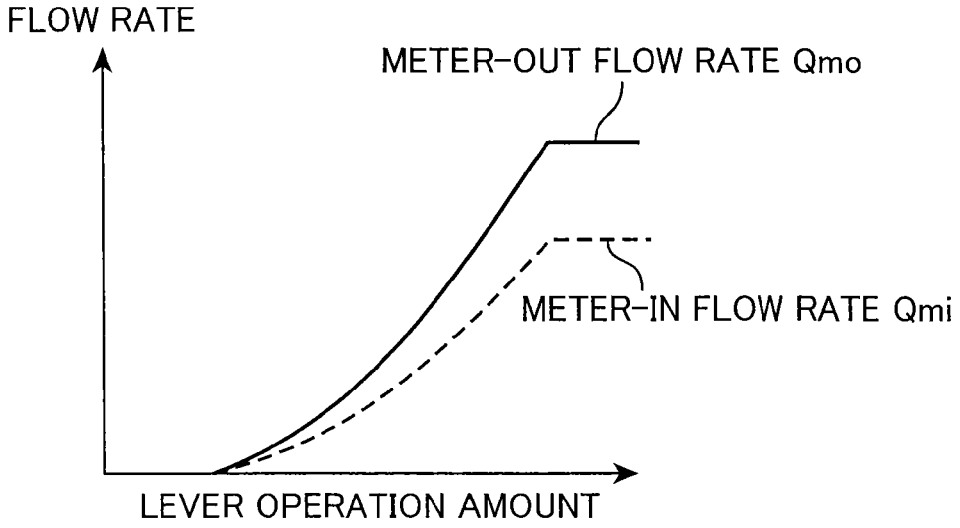
FIG. 3 is a graph showing a relationship between the lever operation amount and a meter-out flow rate and a meter-in flow rate.

The characteristic of the opening area of the meter-in orifice 31 constituting the meter-in-flow-rate controller, namely, the meter-in opening area Ami, and the characteristic of the opening area of the meter-out orifice valve 36 constituting the meter-out-flow-rate controller, namely, the meter-out opening area Amo, are set such that, as shown in FIG. 2, the meter-out opening area Amo is not smaller than the meter-in opening area Ami regardless of the lever operation amount, more specifically, such that the meter-out opening area Amo is larger than the meter-in opening Ami except in a region where the lever operation amount is 0 or near 0. The apparatus according to this embodiment is thus given such a flow rate characteristic that the meter-out flow rate Qmp is kept not lower than the meter-in flow rate Qmi regardless of the lever operation amount, more specifically, the meter-out flow rate Qmo is kept higher than the meter-in flow rate Qmi except in the region where the lever operation amount is 0 or near 0 as shown in FIG. 3.

The connection line 100 interconnects the first control valve 3 and the second control valve 103. Specifically, the connection line 100 is connected to each of the first and second control valves 3, 103 so as to introduce the hydraulic fluid flowed in the meter-out flow passage formed by the second motor line 82M when the first control valve 3 is switched to the lowering drive position P1 and the hydraulic fluid flowed in the meter-out flow passage formed by the first motor line 81M when the first control valve 3 is switched to the lowering driver position P2 into an inlet port of the second control valve 103.

The second hydraulic motor 104, which is an example of a second hydraulic actuator according to the present invention, includes an A-port 104*a* and a B-port 104*b* similarly to the first hydraulic motor 4 and is adapted to be rotated, when the hydraulic fluid is supplied to one of these ports, in a direction corresponding to the port and discharge the hydraulic fluid through the other port. The second hydraulic circuit C2 includes a first motor line 181M and a second motor line 182M, the first motor line 181M connecting the A-port 104*a* to the second control valve 103 while the second motor line 182M connecting the B-port 104*b* to the second control valve 103.

The second control valve 103 is interposed between the connection line 100 and the second hydraulic motor 104 to switch a driving state of the second hydraulic motor 104 according to an operation applied to the second operating device 106. Specifically, this second control valve 103 is configured by a three-position pilot-controlled selector valve including a pair of pilot ports 103*a*, 103*b* similarly to the first control valve 3 and operated: to be held at a neutral position P10 when no pilot pressure is supplied to either of the pilot ports 103*a*, 103*b*; to be opened from the neutral position P10 toward a drive position P11 or P12 when the pilot pressure is supplied to the pilot port 103*a* or 103*b*. The second control valve 103 blocks the both motor lines 181M, 182M and forms an fluid passage for connecting the connection line 100 to the tank line 180 at the neutral position P10, forms an fluid passage for connecting the connection line 100 to the first motor line 181M and connecting the second motor line 182M to the tank line 180 via an auxiliary tank line 170 at the drive position P11, and forms an fluid passage for connecting the connection line 100 to the second motor line 182M and connecting the first motor line 181M to the tank line 180 via the auxiliary tank line 170, at the drive position P12.

The second operating device 106 includes a remote-controlled valve 110 for outputting a pilot pressure utilizing the pilot fluid pressure source 9. The remote-controlled valve 110 includes an operation lever 110*a* and a valve main body 110*b* similarly to the remote-controlled valve 10. The valve main body 110*b* is adapted to output, when an operation is applied to the operation lever 110*a*, a pilot pressure of a magnitude corresponding to an amount of the operation applied to the operation lever 110*a* to the pilot port corresponding to a direction of the operation applied to the operation lever 110*a*, out of the both pilot ports 103*a*, 103*b* of the second control valve 103.

The back pressure valve 15 is a pressure control valve, which generates a back pressure equivalent to a set pressure thereof in the tank line 180 downstream of the second hydraulic circuit C2. The set pressure of this back pressure valve 15 may be constantly fixed or may have, for example, such a characteristic that the set pressure is decreased with an increase in a meter-in pressure in the first hydraulic circuit C1, i.e., a pressure in the meter-in flow passage during lowering drive. Alternatively, the back pressure valve 15 can also be a variable orifice valve having an opening area which is increased with an increase in the operation amount of the operation lever 10*a*. In this case, its opening area Abk is set to have, for example, such a characteristic as shown in the following Equation (1).

$$Abk=Qbk/\{Cv\times\sqrt{\Delta Pbk}\} \quad (1)$$

Here, Cv denotes a flow rate coefficient, ΔPbk denotes the set pressure of the back pressure valve and Qbk denotes a flow rate of the hydraulic fluid passing through the back pressure valve, and the flow rate Qbk coincides with the meter-in flow rate Qmi due to a flow rate balance if a leakage is ignored.

The regeneration line 12 forms an fluid passage for supplying a part of the hydraulic fluid flowing in the tank line 180 (i.e., hydraulic fluid having been flowed in the second hydraulic circuit C2) to the meter-in flow passage side in the first hydraulic circuit C1 from a position upstream of the back pressure valve 15 at a flow rate corresponding to a difference between the meter-out flow rate Qmo and the meter-in flow rate Qmi (≤Qmo) during lowering drive. Specifically, the regeneration line 12 is branched off from the tank line 180 at a position upstream of the back pressure valve 15 and reaches the first motor line 81M. The check valve 13 is provided midway of the regeneration line 12 to limit a direction of the flow of the hydraulic fluid in the regeneration line 12 to a direction from the meter-out flow passage to the meter-in flow passage.

The second motor line 82M is further provided with a check valve 35 located downstream of the meter-out orifice valve 36 and the meter-out-flow-rate regulating valve 14. This check valve 35 permits only a flow of the hydraulic fluid in a direction from the first hydraulic motor 4 toward the first control valve 3 while prevents the opposite flow, in other words, preventing the hydraulic fluid discharged from the hydraulic pump 2 from backflow into the second motor line 82M when the first control valve 3 is switched to the hoisting drive position P2.

The bypass line 88 forms a supply flow passage for bringing the hydraulic fluid into flow from the hydraulic pump 2 toward the B-port 4*b* of the first hydraulic motor 4 during hoisting drive. The bypass line 88 is provided with a check valve 27 for permitting only a flow of the hydraulic fluid in a direction from the control valve 3 toward the B-port 4*b* of the first hydraulic motor 4, contrary to the check valve 35.

Next will be explained functions of this apparatus.

Upon an application of an operation for hoisting drive to the operation lever 10*a* of the remote-control valve 10 of the first operating device 6, the remote-control valve 10 outputs a remote-control pressure, which is input to the hoisting drive pilot port 3*b* of the first control valve 3 to cause the first control valve 3 to be opened from the neutral position P0 toward the hoisting drive position P2. This allows the hydraulic fluid discharged from the hydraulic pump 2 to be supplied to the B-port 4*b* of the hydraulic motor 4 via the check valve 27 in the bypass line 88 to rotate the first hydraulic motor 4 in a hoisting drive direction. The hydraulic fluid discharged from the A-port 4*a* of the hydraulic motor 4 is returned to the tank through the first motor line 81M and the connection line 100.

On the other hand, upon an application of an operation for lowering drive to the operation lever 10*a*, the first control valve 3 is operated to be opened from the neutral position P0 toward the lowering drive position P1. Specifically, there is introduced a lowering-drive pilot pressure of a magnitude corresponding to the operation amount of the operation lever 10*a* from the remote-control valve 10 to the lowering drive pilot port 3*a* through the lowering drive pilot line 11*a*, thereby operating the first control valve 3 toward the lowering drive position P1 by a stroke corresponding to the pilot pressure.

This operation decreases the bleed-off opening area Abo and increases the meter-in opening area Ami, which is the opening area of the meter-in orifice 31, as shown in FIG. 4, thereby increasing the meter-in flow rate Qmi, that is, a flow rate of the hydraulic fluid supplied from the hydraulic pump 2 to the A-port 4*a* of the hydraulic motor 4. The hydraulic motor 4 is thereby rotated in a lowering direction while discharging the hydraulic fluid from the B-port 4*b*. Thus discharged hydraulic fluid is returned to the tank through the second motor line 82M and the connection line 100 constituting the meter-out flow passage.

At this time, with the increase in the opening area of the meter-in orifice 31, namely, the meter-in opening area Ami, the meter-in-flow-rate controller constituted by the meter-in orifice 31 and the meter-in-flow-rate regulating valve 23 controls the meter-in flow rate Qmi as shown in FIG. 3. Specifically, the meter-in-flow-rate regulating valve 23 is operated to be opened so as to make the differential pressure across the meter-in orifice 31 be a preset pressure, namely, a set differential pressure ΔPmi. For example, with the increase in the differential pressure across the meter-in orifice 31, the meter-in-flow-rate regulating valve 23 is operated in a valve opening direction to increase the bleed-off flow rate and thereby decrease the meter-in orifice flow rate. The meter-in flow rate Qmi is thus controlled, as shown by the following Equation (2).

$$Qmi = Cv \cdot Ami \cdot \sqrt{(\Delta Pmi)} \quad (2)$$

Meanwhile, the opening area of the orifice 36*a* of the meter-out orifice valve 36 provided in the second motor line 82M, namely, the meter-out opening area Amo, is varied in a range larger than that of the variation in the meter-in opening area Ami as shown in FIG. 2 according to the operation amount of the operation lever 10*a*. Associated with this, the meter-out-flow-rate controller including the meter-out orifice valve 36 and the meter-out-flow-rate regulating valve 14 controls the meter-out flow rate Qmo to a flow rate not lower than the meter-in flow rate Qmi as shown in FIG. 3. Specifically, the meter-out-flow-rate regulating valve 14 is operated to be opened so as to make the differential pressure across the meter-out orifice valve 36 be a preset pressure, namely, a set differential pressure ΔPmo, thereby allowing the meter-out flow rate Qmo to be controlled as shown by the following Equation (3).

$$Qmo = Cv \cdot Amo \cdot \sqrt{(\Delta Pmo)} \quad (3)$$

While the meter-out flow rate Qmo is thus controlled, lowering drive is performed at a speed corresponding to the operation applied to the operation lever 10*a*, regardless of the weight of a load (suspended load 7 in this embodiment). In other words, the meter-out-flow-rate controller performs the control of the meter-out flow rate exclusively in accordance with the operation amount of the operation lever 10*a* regardless of a change in the weight of the suspended load 7 as the load. This makes it possible to effectively suppress a variation in the rotation speed of the first hydraulic motor 4 due to an increase or decrease in the weight of the load to contribute to improved operability and safety.

In addition, this apparatus, controlling the meter-out flow rate Qmo to keep it constantly not lower than the meter-in flow rate Qmi, enables return fluid to be supplied to the first motor line 81M, which is the meter-in flow passage, from the connection position Pc upstream of the back pressure valve 15 through the regeneration line 12 at a flow rate (Qmo−Qmi) equivalent to a shortage of the meter-in flow rate Qmi. Thus, the flow of the hydraulic fluid from the meter-out flow passage to the meter-in flow passage through the regeneration flow passage is reliably produced, and further the flow is stably maintained by the control of both of the flow rates Qmi and Qmo. This allows the meter-in pressure to be maintained not lower than the set pressure of the back pressure valve 15, thus preventing cavitation due to a drop in the meter-in pressure.

As a conventional technique for preventing such cavitation, known is a technique with use of a counter balance valve; however, the use of such a counter balance valve has a disadvantage of involving hunting in the meter-in pressure or generation of a notable boost pressure. Contrary to this, the above apparatus is capable of preventing the cavitation with no use of the counter balance valve involving the disadvantage.

Figure 5:
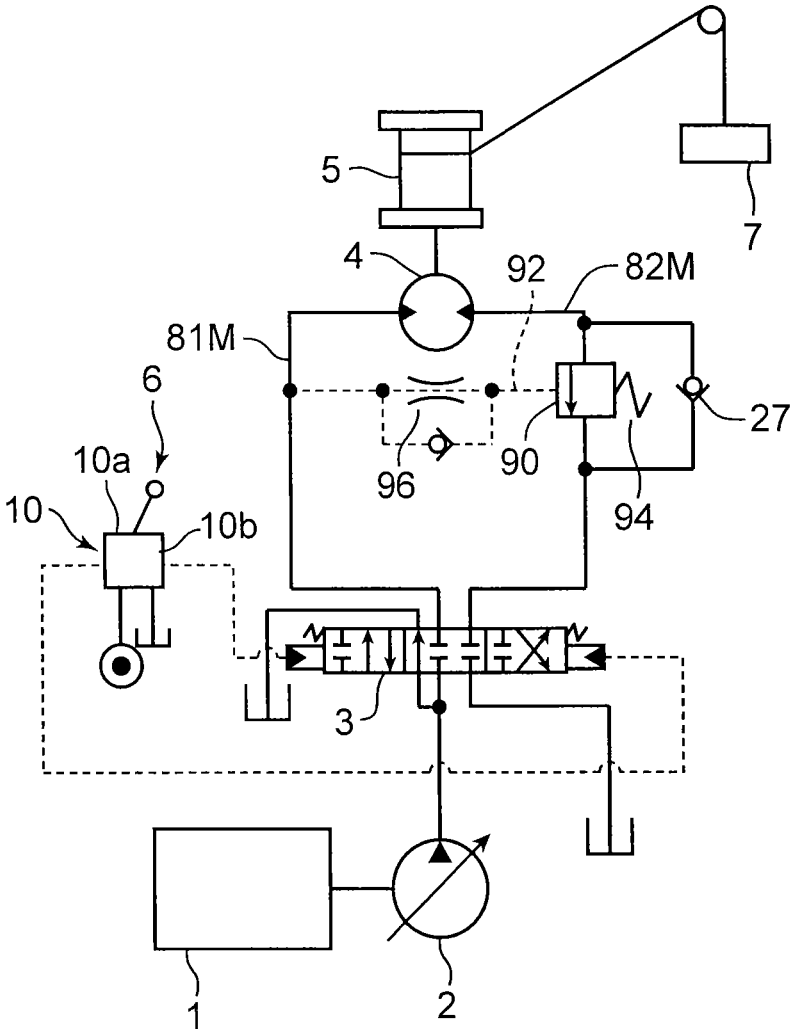
FIG. 5 is a circuit diagram showing a hydraulic drive apparatus according to a first comparative example.

The superiority of the inventive apparatus on this point is described in detail based on a comparison with an apparatus shown in FIG. 5 assumed as a first comparative example. This apparatus shown in FIG. 5, while including an engine 1, a hydraulic pump 2, a first control valve 3, a first hydraulic motor 4, a first operating device 6 and both motor lines 81M, 82M similarly to the apparatus shown in FIG. 1, further includes an external-pilot-controlled counter balance valve 90 instead of the regeneration flow passage, the meter-in-flow-rate controller, the meter-out-flow-rate controller, and the back pressure valve 15 included in the apparatus shown in FIG. 1.

This counter balance valve 90 receives an introduction of a pressure in the first motor line 81M constituting a meter-in flow passage for lowering drive, namely, a meter-in pressure, as a pilot pressure through a line 92. The counter balance valve 90 includes a spring 94 determining a set pressure Pcb thereof, and is adapted to be closed when the pilot pressure input to the counter balance valve 90, namely, the meter-in pressure, is below the set pressure Pcb, and to be opened when the meter-in pressure is not lower than the set pressure Pcb.

Concerning the prevention of the cavitation due to a shortage of a meter-in flow rate, the counter balance valve 90 is also effective. For example, when the rotation speed of the first hydraulic motor 4 is increased due to the weight of a suspended load 7 to thereby cause an absorbing flow rate thereof to exceed a supply flow rate from the hydraulic pump 2, the meter-in pressure decreases, but, upon decrease in the meter-in pressure to the set pressure Pcb of the counter balance valve 90, the counter balance valve 90 is operated in a valve closing direction to choke the meter-out side, thereby causing a braking force to be applied to the first hydraulic motor 4. The absorbing flow rate of the first hydraulic motor 4 is thus limited, allowing a control of keeping the meter-in pressure not lower than the set pressure Pcb to be achieved.

Figure 6A:
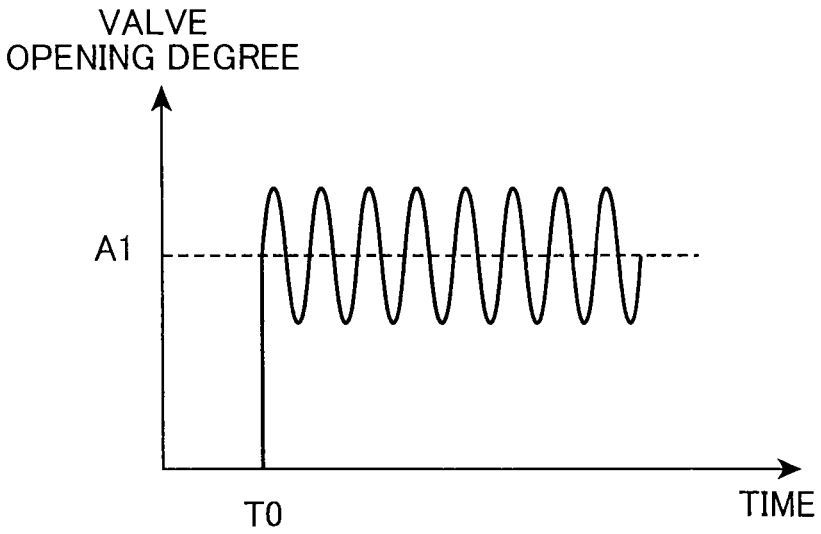
FIGS. 6A and 6B are graphs showing, respectively, hunting in counter balance valve opening degree and hunting in meter-in pressure which might occur in the apparatus shown in FIG. 5.
Figure 6B:
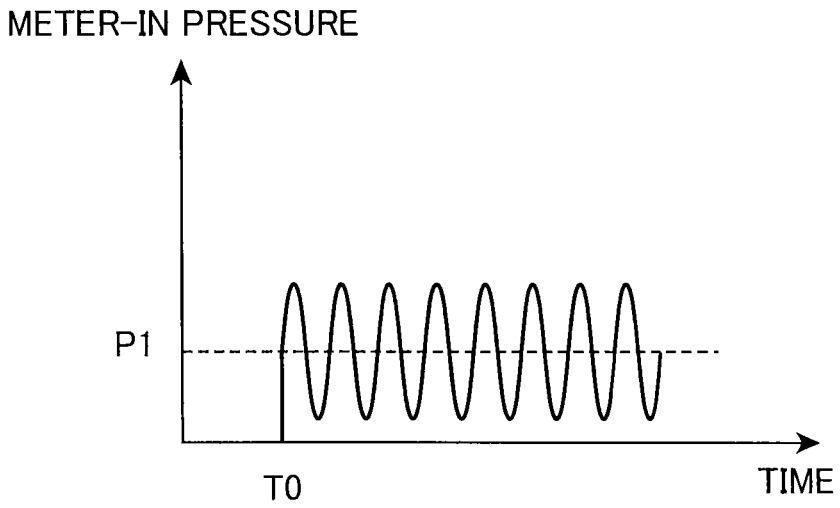

However, the control with use of the counter balance valve 90, where a measurement point is located in the meter-in flow passage while a control point is located in the meter-out flow passage, has no co-location in control theory, which makes the control be unstable. In other words, the position difference between the measurement point and the control point makes the control by the counter balance valve 90 be so unstable as to allow hunting to easily occur. Specifically, upon operation applied to the operation lever 10*a* of the remote-control valve 10 of the first operating device 6 in a lowering driving direction to shift the lever 10*a* from a neutral position at time T0, there occurs hunting in the opening degree of the counter balance valve 90 as shown in FIG. 6A, and this hunting may cause also the meter-in pressure to vary in a vibrating manner as shown in FIG. 6B to thereby make the rotation speeds of the first hydraulic motor 4 and a winch drum 5 be unstable.

Figure 7A:
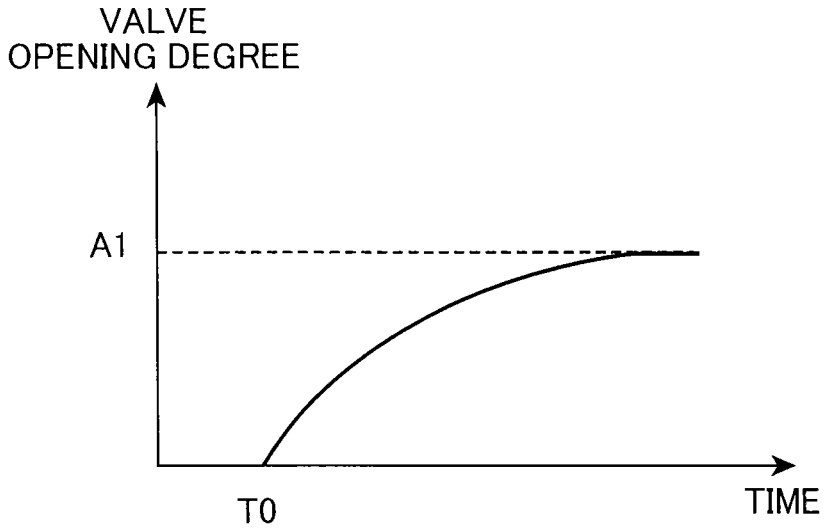
FIG. 7A is a graph showing a change with time in the valve opening degree immediately after the open of the counter balance valve and FIG. 7B is a graph showing a change with time in the meter-in pressure associated with a change in the valve opening degree.
Figure 7B:
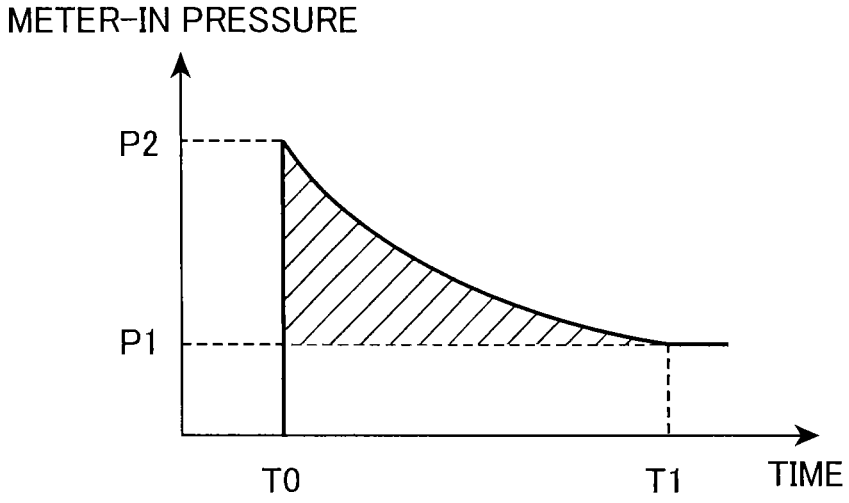

As a means for preventing this hunting, generally considered is providing an orifice 96 to the line 92 midway thereof as shown in FIG. 5; however, the orifice 96 causes a considerable response delay between time T0 when the operation of the operation lever 10*a* is started and a point of time when the valve opening degree reaches an appropriate opening degree A1 as shown in FIG. 7A. Furthermore, there occurs a great pressure loss in the counter balance valve 90 until the counter balance valve 90 is sufficiently opened, which causes a state where the meter-in pressure is higher than the set pressure Pcb, that is, a state where a useless boost pressure is generated as shown by hatching in FIG. 7B, to be continued from the operation start time T0 to specified time T1 as shown in FIG. 7B; this results in a disadvantage of drastically reducing operation efficiency.

Figure 8A:
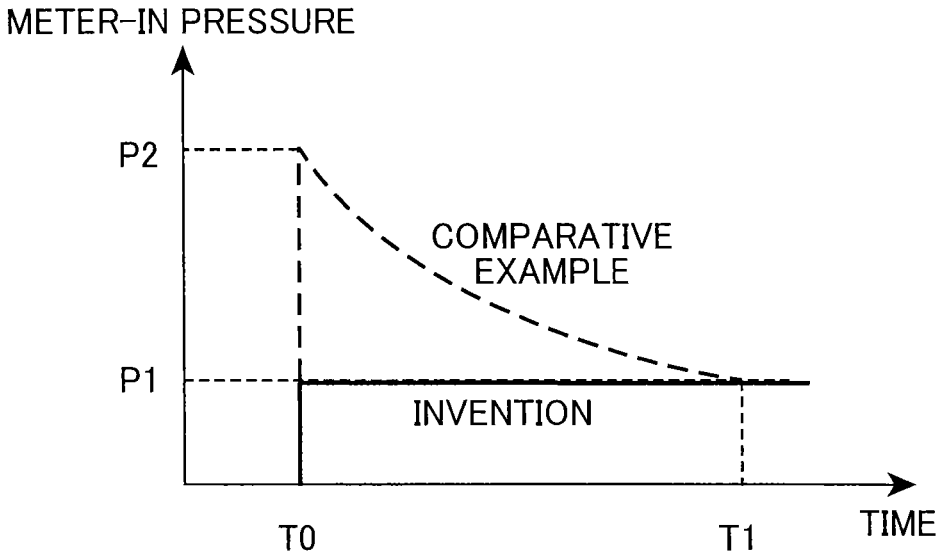
FIG. 8A is a graph showing respective changes with time in the meter-in pressure in the apparatus shown in FIG. 1 and the apparatus shown in FIG. 5
Figure 8B:
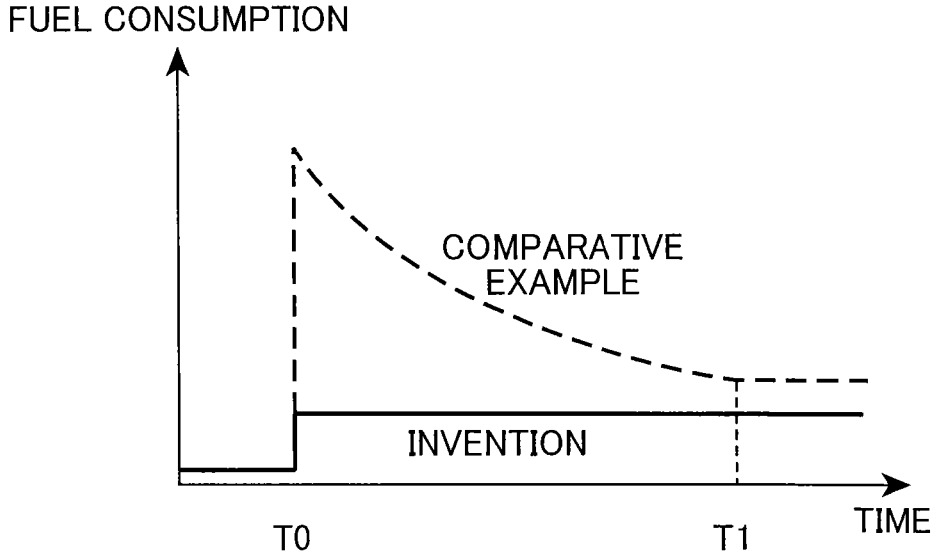
FIG. 8B is a graph showing respective changes with time in fuel consumption in the apparatus shown in FIG. 1 and the apparatus shown in FIG. 5.

On contrary, the meter-out-flow-rate controller used in the apparatus shown in FIG. 1, which regulates the meter-out flow rate based on the differential pressure across the meter-out orifice and has a measurement point and a control point both located in the meter-out flow passage, has a co-location in control theory and is therefore capable of performing a stable control. Furthermore, the back pressure valve 15, which is very unlikely to involve hunting differently from the counter balance valve 90, requires no addition of a special orifice for preventing the hunting; therefore, there is no occurrence of the notable boost pressure as shown in FIG. 7B. Thus, as shown by solid line (apparatus shown in FIG. 1) and by broken line (apparatus shown in FIG. 5) in FIG. 8A, the meter-in pressure is effectively suppressed and power necessary to drive the hydraulic pump 2 is thereby reduced drastically, resulting in drastic improvement of also fuel consumption of the engine as shown in FIG. 8B.

Moreover, in the apparatus shown in FIG. 1, the second hydraulic circuit C2 interposed between the meter-out flow passage of the first hydraulic circuit C1 and the tank leads the hydraulic fluid flowed in the meter-out flow passage to the second hydraulic motor 104 as the second hydraulic actuator and leads the hydraulic fluid discharged from the second hydraulic motor 104 to the tank, thereby enabling the both hydraulic motors 1, 104 to be driven by use of the common hydraulic pump 2. In addition, the regeneration line 12, returning not the hydraulic fluid flowed in the meter-out flow passage of the first hydraulic circuit C1 but the hydraulic fluid flowed in the second hydraulic circuit C2 before reaching the back pressure valve to the meter-in flow passage of the first hydraulic circuit, can supply the regenerated fluid having a stable pressure regardless of the load of the second hydraulic motor 104 as the second hydraulic actuator to the meter-in flow passage of the first hydraulic circuit C1.

Figure 9:
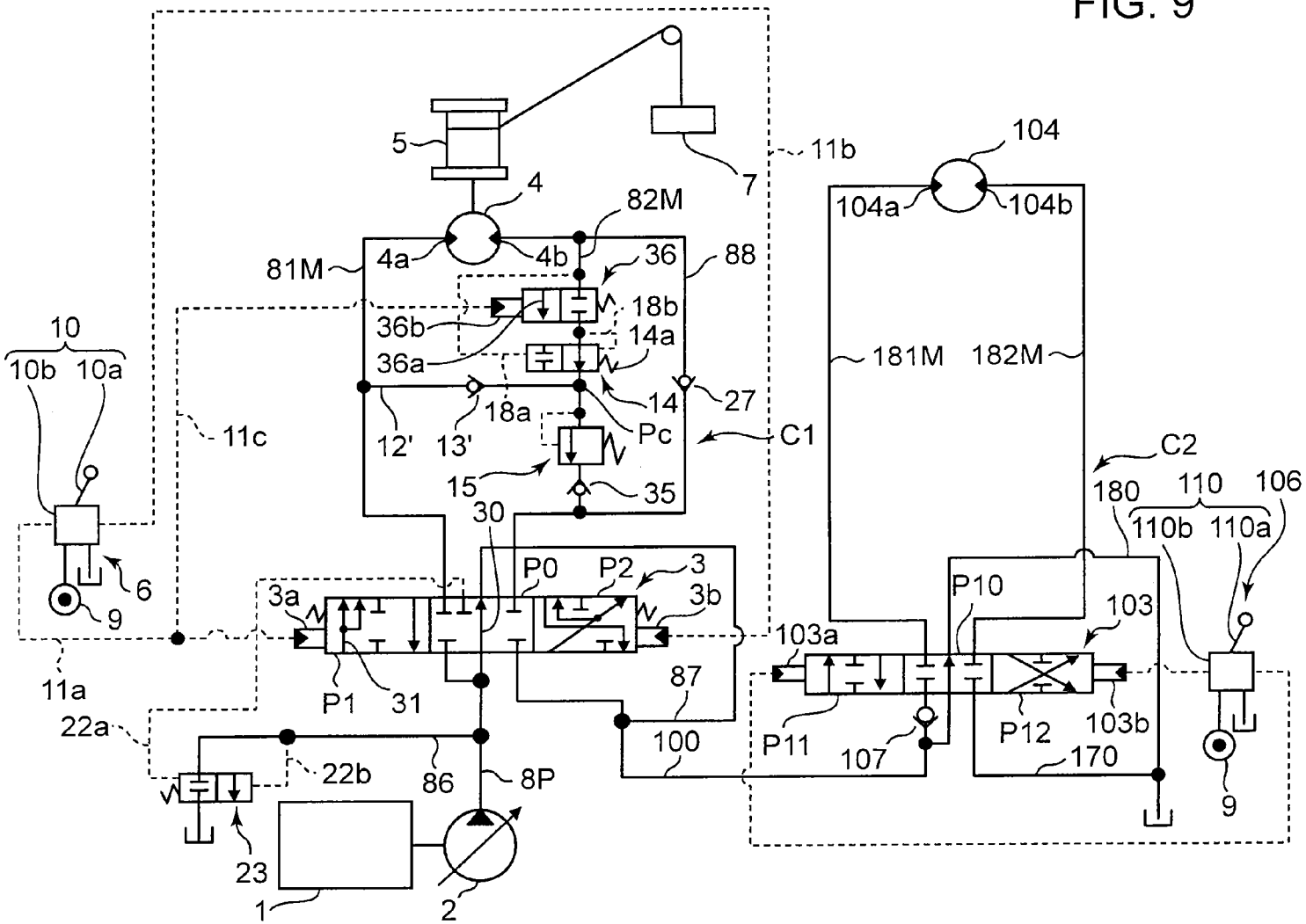
FIG. 9 is a circuit diagram showing a hydraulic drive apparatus according to a second comparative example.

The superiority of the apparatus shown in FIG. 1 is described in contrast to an apparatus shown in FIG. 9 assumed as a second comparative example. The apparatus shown in FIG. 9 has the same basic configuration as the apparatus shown in FIG. 1, while differing in the following points: the back pressure valve 15 is provided not in a tank line 180 but between a meter-out-flow-rate regulating valve 14 and a check valve 35 in a second motor line 82M, and, instead of the regeneration line 12, there is incorporated a regeneration line 12' arranged to supply hydraulic fluid upstream of the back pressure valve 15 in the second motor line 82M to a meter-in flow passage, namely, a first motor line 81M, into a first hydraulic circuit C1.

Figure 10A:
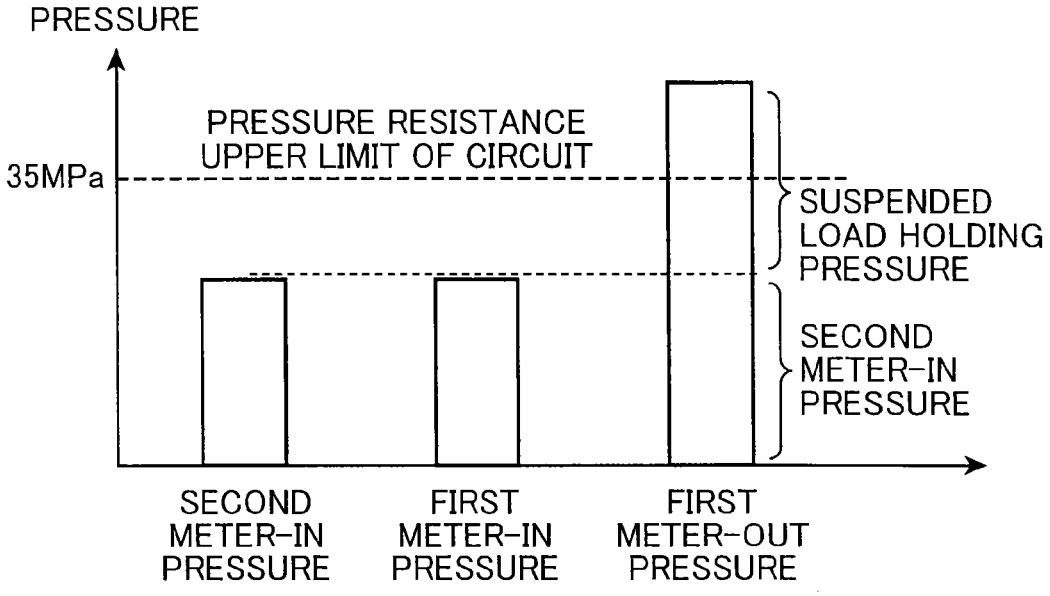
FIG. 10A is a graph showing a meter-in pressure of a second hydraulic circuit and a meter-in pressure and a meter-out pressure of a first hydraulic circuit in the hydraulic drive apparatus according to the second comparative example and FIG. 10B is a graph showing a meter-in pressure of a second hydraulic circuit and a meter-in pressure and a meter-out pressure of a first hydraulic circuit in the hydraulic drive apparatus shown in FIG. 1.

In this apparatus, as shown in FIG. 10A, the pressure of regenerated fluid returned by the regeneration line 12' includes not only a set pressure of the back pressure valve but also a motor differential pressure equivalent to a load of a second hydraulic motor 104 as a second hydraulic actuator, that is, correspond to a pressure equivalent to a meter-in pressure in a second hydraulic circuit C2, namely, "second meter-in pressure" shown in FIG. 10A; therefore, depending on the load of the second hydraulic motor 104, for example, in the case where the second hydraulic motor 104 is a winch motor and driven in a hoisting direction, there is a possibility that regenerated fluid having a high pressure equivalent to the second meter-in pressure, which is the meter-in pressure in the second hydraulic circuit C2, is supplied to a meter-in flow passage of the first hydraulic circuit C1 and drastically increases a pressure in the meter-in flow passage ("first meter-in pressure" shown in FIG. 10A). Furthermore, upon driving the first hydraulic motor 4 to move a suspended load 7 as a load in a lowering direction, the meter-out pressure ("first meter-out pressure" shown in FIG. 10A), which is a pressure in a meter-out flow passage, becomes a pressure obtained by adding a pressure corresponding to the load, i.e., a holding pressure for holding the suspended load 7, to the first meter-in pressure, which excessively increases the meter-out pressure to adversely affect pipes and various components constituting the meter-out flow passage. In other words, there can be cases where the load of the second hydraulic motor 104 has to be significantly limited to avoid such an excessive increase in the meter-out pressure.

Figure 10B:
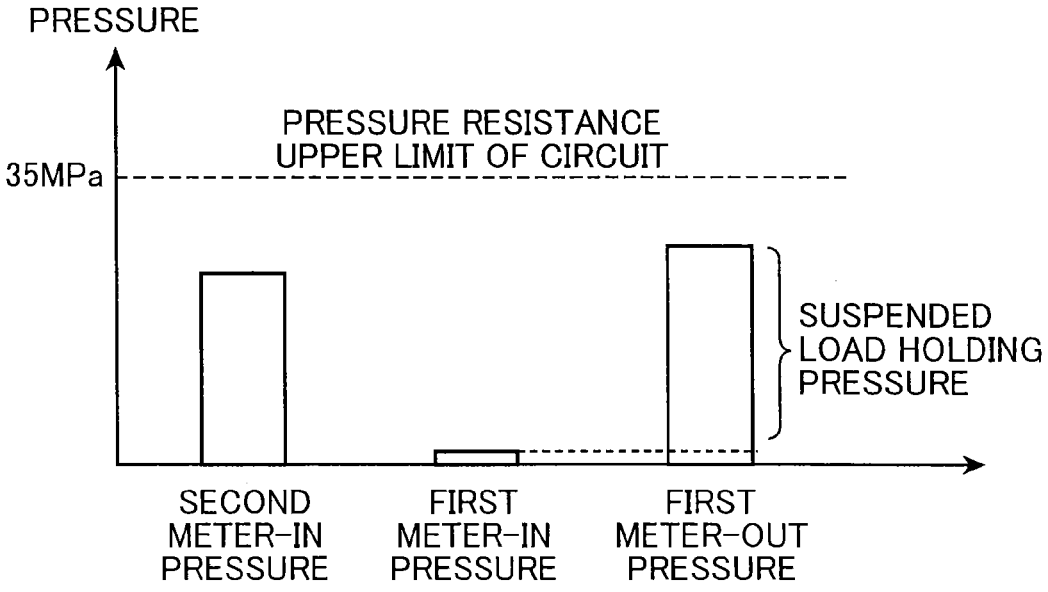

Contrary to this, the regeneration line 12 shown in FIG. 1, which leads the hydraulic fluid flowed in the tank line 180 downstream of the second hydraulic circuit C2 and upstream of the back pressure valve 15 to the meter-in flow passage as the regenerated fluid, allows a pressure of the regenerated fluid, namely, a second meter-in pressure, to be stabilized at a pressure equivalent to the set pressure of the back pressure valve 15 regardless of the load of the second hydraulic motor 104. This set pressure of the back pressure valve 15 is only required to be such a pressure capable of preventing cavitation in the meter-in flow passage of the first hydraulic motor 4, thus allowed to be a low pressure. Hence, as shown in FIG. 10B, a first meter-in pressure and a first meter-out pressure downstream thereof, which are affected by the pressure of the regenerated fluid, can be suppressed to low values regardless of the magnitude of the second meter-in pressure. This makes it possible to perform a stable lowering drive of the first hydraulic motor 4 despite the series arrangement of the first and second hydraulic motors 4, 104.

Figure 11:
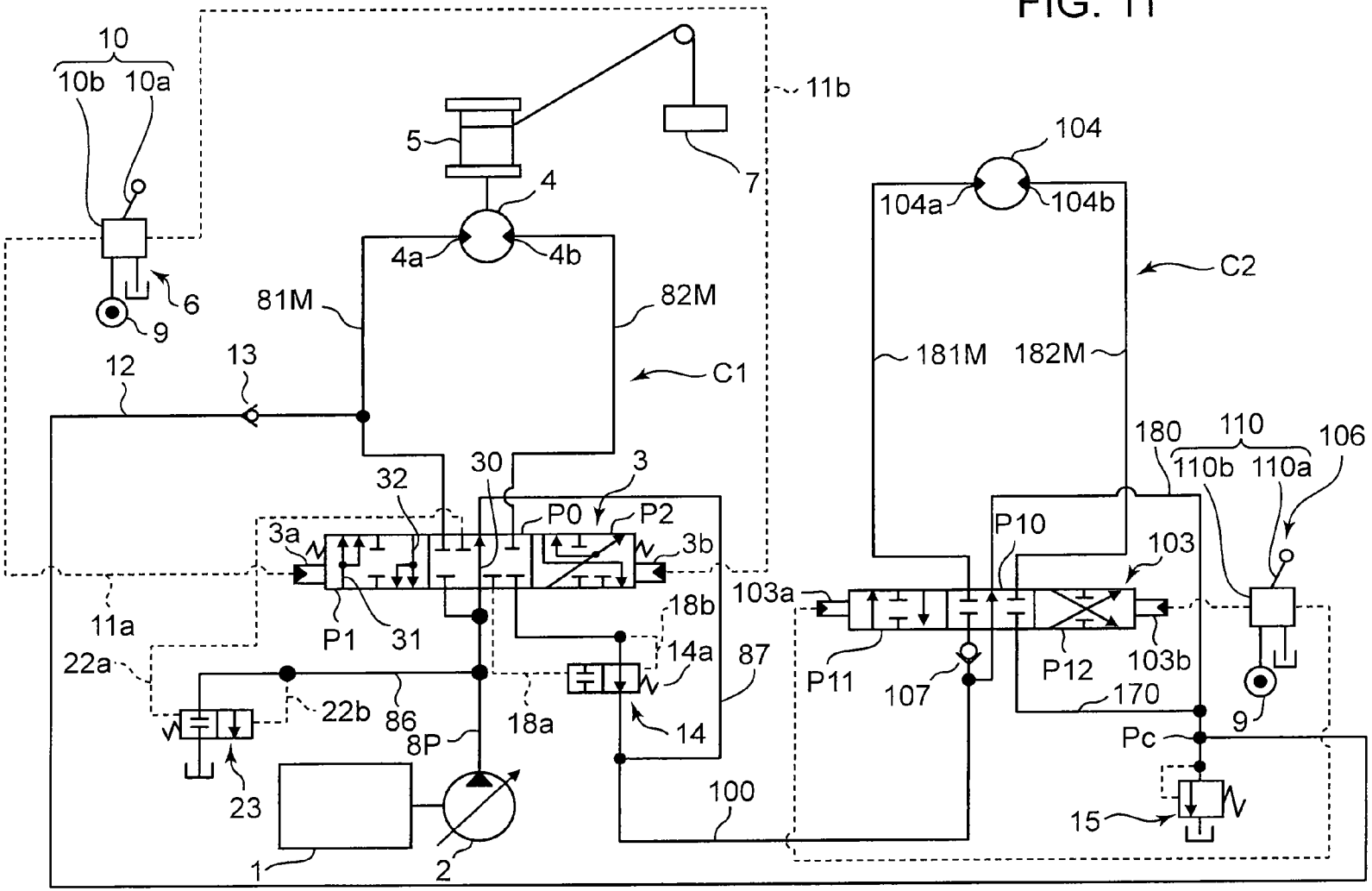
FIG. 11 is a circuit diagram showing a hydraulic drive apparatus for working machine according to a second embodiment of the present invention.

FIG. 11 shows an apparatus according to a second embodiment of the present invention. This apparatus differs from the apparatus shown in FIG. 1 in the position and configuration of the meter-out-flow-rate controller. Specifically, while both of the meter-out orifice valve 36 and the meter-out-flow-rate regulating valve 14 which are constituting the meter-out orifice in the apparatus shown in FIG. 1 are provided in the second motor line 82M upstream of the first control valve 3, the apparatus shown in FIG. 11 includes a meter-out orifice 32 and a meter-out-flow-rate regulating valve 14 but the meter-out orifice 32 is provided in a first control valve 3 similarly to a meter-in orifice 31 and the meter-out-flow-rate regulating valve 14 is provided in a flow passage connected to a connection line 100 at a side downstream of the first control valve 3.

Although the first control valve 3 shown in FIG. 11 forms a return flow passage interconnecting a second motor line 82M and the connection line 100 at a lowering drive position P1 similarly to the first control valve 3 shown in FIG. 1, this return flow passage constitutes the meter-out orifice 32. This meter-out orifice 32, similarly to the meter-in orifice 31, has such a characteristic that the opening area of the meter-out orifice 32 is increased with an increase in the stroke of the first control valve 3. As to an extraction of the differential pressure across this meter-out orifice 32, the pressure upstream of the meter-out orifice 32 is introduced from the first control valve 3 to an inlet port of the meter-out-flow-rate regulating valve 14 through a line 18*a* and the pressure downstream of the meter-out orifice 32 (inlet-side pressure of the meter-out-flow-rate regulating valve 14 in FIG. 11) is introduced to an outlet port (port opposite to the inlet port) of the meter-out-flow-rate regulating valve 14 through a line 18*b*.

This arrangement allows the apparatus shown in FIG. 11 to require none of the check valve 35 and the bypass line 88 shown in FIG. 1. On the other hand, the position of the back pressure valve 15 and the connection position Pc of the regeneration line 12 upstream of the back pressure valve 15 is not different.

Also in this apparatus, during lowering drive, the first control valve 3 is shifted toward the lowering drive position P1 by a stroke corresponding to the operation amount of an operation lever 10*a*, thereby varying the opening area of the meter-out orifice 32 in the first control valve 3 according to the stroke, and the meter-out-flow-rate regulating valve 14 is operated so as to keep the differential pressure across the meter-out orifice 32 at a predetermined pressure to control the meter-out flow rate fitted to an operation regardless of the weight of a load (suspended load 7). Besides, the hydraulic fluid is returned from a tank line 180 to a meter-in flow passage of a first hydraulic circuit C1 in the same manner as in the apparatus shown in FIG. 1.

The first control valve 3 is not limited to a pilot-controlled hydraulic selector valve but may be, for example, a three-position electromagnetic selector valve. Also in this case, stable lowering drive is realized if the meter-out-flow-rate controller is one which controls a meter-out flow rate according to an operation in the operating device, for example, one based on a combination of the meter-out orifice valve 36 and the meter-out-flow-rate regulating valve 14 as shown in FIG. 1.

In the present invention, specific configuration and usage of the second hydraulic actuator and specific configuration of the second hydraulic circuit for driving the second hydraulic actuator do not matter. For example, the second hydraulic actuator may be provided to move a load in the lowering direction like the first hydraulic actuator (e.g. motor of a hydraulic winch). In this case, the above effects about driving the first hydraulic actuator is allowed to be obtained also about driving the second hydraulic actuator, in the following condition: the second hydraulic circuit includes a meter-in flow passage and a meter-out flow passage similarly to the first hydraulic circuit; a meter-in-flow-rate controller and a meter-out-flow-rate controller are provided for the meter-in flow passage and the meter-out flow passage, respectively, to control the meter-in flow rate and meter-out flow rate so as to make the meter-out flow rate greater than the meter-in flow rate; and the hydraulic fluid corresponding to the difference between the meter-in and meter-out flow rates is brought into regeneration from the meter-out flow passage to the meter-in flow passage.

Figure 12:
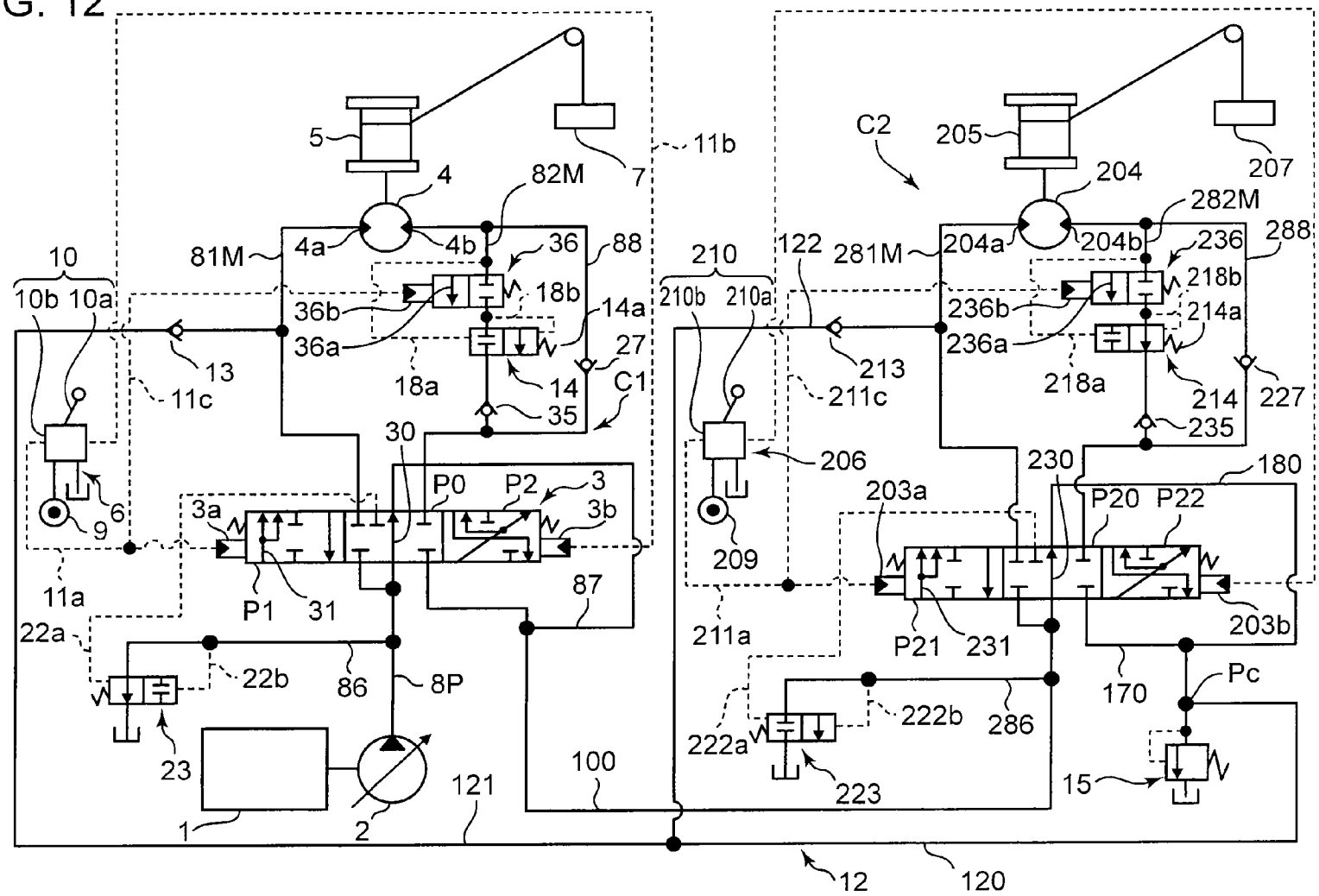
FIG. 12 is a circuit diagram showing a hydraulic drive apparatus for working machine according to a third embodiment of the present invention.

FIG. 12 shows an example thereof as a third embodiment. FIG. 12 shows an apparatus, where a part upstream of a connection line 100, that is, a part relating to a first hydraulic motor 4, is exactly the same as in the apparatus shown in FIG. 1. Meanwhile, a part downstream of the connection line 100, which is to drive a second hydraulic motor 204 for rotating a winch drum 205 adapted to lower and hoist a suspended load 207, includes: a second hydraulic circuit C2 for driving the second hydraulic motor 204; a second operating device 206 for an operation on the rotation speed of the second hydraulic motor 204; a second control valve 203 for switching an fluid passage of the second hydraulic circuit C2; a second meter-out-flow-rate controller; and a second meter-in-flow-rate controller.

The second hydraulic motor 204 includes an A-port (second inlet port for lowering drive) 204*a* and a B-port (second outlet port for lowering drive) 204*b*, similarly to the first hydraulic motor 4, adapted to rotate the winch drum 205 in a lowering direction, i.e., in a direction to lower the suspended load 207, and discharge hydraulic fluid through the B-port 204*b* when the hydraulic fluid is supplied to the A-port 204*a*, and adapted to rotate the winch drum 205 in a hoisting direction, i.e., in a direction to hoist the suspended load 207, and discharge the hydraulic fluid through the A-port 204*a* when the hydraulic fluid is supplied to the B-port 204*b*.

Similarly to the first hydraulic circuit C1, the second hydraulic circuit C2 includes: a first motor line 281M interconnecting the second control valve 203 and the A-port 204*a* of the second hydraulic motor 204; a second motor line 282M interconnecting the second control valve 203 and the B-port 204*b* of the second hydraulic motor 204; a bypass line 288 provided in parallel with this second motor line 282M; an auxiliary tank line 170 connecting the second control valve 203 to a tank line 180; and a bleed-off line 286 branched off from the connection line 100 and reaching the tank.

The second control valve 203 is interposed between the connection line 100 and the second hydraulic motor 204 and switches a driving state of the winch drum 205 between a hoisting drive state and a lowering drive state according to an operation applied to the second operating device 206. The second control valve 203 is configured by a three-position pilot-controlled selector valve including a lowering pilot port 203*a* and a hoisting pilot port 203*b* similarly to the first control valve 103 and is operated: to be held at a neutral position P20 when no pilot pressure is supplied to either of the pilot ports 203*a*, 203*b*; to be opened from the neutral position P20 toward a lowering drive position P21 by a stroke corresponding to the pilot pressure, which is supplied to the lowering pilot port 203*a*; and to be opened from the neutral position P20 to a hoisting drive position P22 by a stroke corresponding to the pilot pressure, which is supplied to the hoisting pilot port 203*b*.

The second control valve 203 forms fluid passages similarly to the first control valve 3 at the above respective positions. Specifically, at the neutral position P20, the second control valve 203 prevents the hydraulic fluid flowed in the connection line 100 from being supplied to the second hydraulic motor 204 and forms a first bleed-off flow passage to lead the hydraulic fluid to the tank line 180 through the auxiliary tank line 170. Furthermore, the second control valve 203 includes a bleed-off orifice 230 at the neutral position P20 and the bleed-off orifice 230 has an opening area which is decreased with a distance from the neutral position P20.

At the lowering drive position P21, the second control valve 203 connects the connection line 100 to the first motor line 281M to open a flow passage for introducing the hydraulic fluid flowed in the connection line 100 to the A-port 204*a* of the second hydraulic motor 204, namely, a "meter-in flow passage" for lowering drive, and connects the second motor line 282M to the auxiliary tank line 170 (and further the tank line 180) to open a "meter-out flow passage" for lowering drive. Furthermore, the second control valve 203 includes a meter-in orifice 231 at the lowering drive position P21 and the meter-in orifice 231 has an opening area which is increased with an increase in the stroke from the neutral position P20.

At the hoisting drive position P22, the second control valve 203 connects the connection line 100 to the second motor line 282M and the bypass line 288 provided in parallel with the second motor line 282M to thereby form a flow passage for introducing the hydraulic fluid flowed in the connection line 100 to the B-port 204*b* of the second hydraulic motor 204 exclusively through the bypass line 288 and connects the first motor line 281M to the auxiliary tank line 170.

The second operating device 206 includes a pilot fluid pressure source 9, a remote-controlled valve 210, a lowering-drive pilot line 211*a* and a hoisting-drive pilot line 211*b*. The remote-controlled valve 210 includes an operation lever 210*a* and a valve main body 210*b* similarly to the remote-controlled valve 10, and inputs a pilot pressure to the pilot ports 203*a*, 203*b* of the second control valve 203 through the respective pilot lines 211*a*, 211*b*, respectively, when each of respective operations for lowering drive and for hoisting drive is applied to the operation lever 210*a*. The relationship between an operation amount of the operation lever 210*a* (in the lowering direction) and the opening area of the meter-in orifice 231 and the relationship between the operation amount and the opening areas of the bleed-off orifice 230 and the meter-in orifice 231 are exactly the same as those shown in FIGS. 2 and 4.

The second meter-in-flow-rate controller includes the meter-in orifice 231 and a meter-in-flow-rate regulating valve 223 provided in the bleed-off line 286 similarly to the meter-in-flow-rate controller (first meter-in-flow-rate controller) provided for the first hydraulic motor 4. Similarly to the meter-in-flow-rate regulating valve 23, the meter-in-flow-rate regulating valve 223 has so variable an opening degree as to make a difference between pressures upstream of and downstream of the meter-in orifice 231, i.e., a differential pressure across the meter-in orifice 231, be a predetermined set differential pressure. Specifically, when the differential pressure across the meter-in orifice 231 is increased, the meter-in-flow-rate regulating valve 223 is operated in a valve opening direction to increase a flow rate in the bleed-off line 286, thereby suppressing the meter-in flow rate.

The second meter-out-flow-rate controller, similarly to the meter-out-flow-rate controller (first meter-out-flow-rate controller) provided for the first hydraulic motor 4, is provided to control a meter-out flow rate, which is a flow rate of the hydraulic fluid in the meter-out flow passage, in accordance with the operation amount of the operation lever 210*a* of the remote-controlled valve 210, namely, a lever operation amount, and includes a meter-out orifice valve 236 and a meter-out-flow-rate regulating valve 214 provided in the second motor line 282M.

The meter-out orifice valve 236 includes an orifice 236*a* having a variable opening area and a pilot port 236*b* to which a lowering drive pilot pressure is input through a branch line 211*c* branched off from the lowering drive pilot line 211*a*. The meter-out orifice valve 236 is operated so as to increase an opening area of the orifice 236*a* with an increase in the input pilot pressure and make the opening area be minimum (preferably 0) when the operation amount is 0.

Similarly to the meter-out-flow-rate regulating valve 14, the meter-out-flow-rate regulating valve 214 is opened and closed to make the differential pressure across the meter-out orifice valve 236 be a predetermined set differential pressure. Specifically, the meter-out-flow-rate regulating valve 214 includes a valve main body capable of being opened and closed and a spring 214*a* for biasing the valve main body in a valve opening direction. The pressure upstream of the meter-out orifice valve 236 is introduced to the meter-out-flow-rate regulating valve 214 through a pressure introducing line 218*a* from a side opposite to the spring 214*a*, and the pressure downstream of the meter-out orifice valve 236 is introduced to the meter-out-flow-rate regulating valve 214 through a pressure introducing line 218*b* from the same side as the spring 214*a*.

The characteristic of the opening area of the meter-in orifice 231 constituting the meter-in-flow-rate controller and the characteristic of the opening area of the meter-out orifice valve 236 constituting the meter-out-flow-rate controller are set to the same characteristics as those shown in FIG. 2, similarly to the first meter-in-flow-rate controller and the first meter-out-flow-rate controller. Specifically, these characteristics are set as to make the meter-out opening area not smaller than the meter-in opening area regardless of the lever operation amount, more specifically, so as to make the meter-out opening area larger than the meter-in opening area except in a region where the lever operation amount is 0 or near 0.

This third embodiment includes a regeneration line 12, which is arranged to return the hydraulic fluid flowed in the tank line 180 not only to the meter-in flow passage of the first hydraulic circuit C1, but also to the meter-in flow passage of the second hydraulic circuit C2, that is, to distribute the hydraulic fluid flowed in the tank line 180 to the both meter-in flow passages. Specifically, the regeneration line 12 shown in FIG. 12 includes: a common fluid passage 120 branched off from the tank line 180 at a connection position Pc upstream of the back pressure valve 15; and a first branch fluid passage 121 and a second branch fluid passage 122 further branched off from this common fluid passage 120. The first branch fluid passage 121 is connected to the first motor line 81M of the first hydraulic circuit C1, while the second branch fluid passage 122 is connected to the second motor line 281M of the second hydraulic circuit C2. The branch fluid passages 121, 122 are provided with respective check valves 13, 213 for limiting directions of the hydraulic fluid flowing in respective branch fluid passages to directions toward respective first and second meter-in flow passages. The regeneration line 12 also may be configured by two lines which are branched off from the tank line 180 at respective positions independently of each other and reach respective meter-in flow passages of the first and second hydraulic circuits C1, C2, i.e., two lines arranged in parallel with each other.

As same as in the first hydraulic circuit C1, the meter-in and meter-out flow rates, in the second hydraulic circuit C2, are controlled so as to make the meter-out flow rate be constantly larger than the meter-in flow rate and a part of the hydraulic fluid flowed in the tank line 180 is supplied to the meter-in flow passage through the common fluid passage 120 and the second branch fluid passage 122 at a flow rate corresponding to a difference between the meter-in and meter-out flow rates. This allows preferable lowering drive of the second hydraulic motor 204 to be realized while preventing cavitation, as with the first hydraulic motor 4. In addition, also in this third embodiment, the pressure of regeneration fluid supplied to each of the hydraulic circuits C1, C2 is a pressure of the hydraulic fluid having been flowed through the second hydraulic circuit C2 and low equivalent to the set pressure of the back pressure valve 15, which prevents the meter-out pressure from such an excessive increase as to influence on the pipes and components constituting the respective hydraulic circuits C1, C211.

The first and second hydraulic actuators according to the present invention are not limited to hydraulic motors but may be, for example, hydraulic cylinders for pivot turning an attachment of a work machine. Specifically, the present invention can be effectively applied to also the case of driving the hydraulic cylinders to move the attachment as a load in a lowering direction which is the same as a direction in which the attachment falls by its own weight.

Alternatively, the first or second hydraulic actuator may be a variable displacement motor.

As described above, according to the present invention, provided is a hydraulic drive apparatus for working machine capable of preventing pressure on a meter-in side from excessive drop while not involving hunting or generation of a large boost pressure, which are drawbacks of a conventional counter balance valve, and capable of moving a load in a lowering direction, which is the same direction as a self-weight falling direction in which the load falls by its own weight, at a stable speed, while connecting a hydraulic actuator for moving the load in the lowering direction and another hydraulic actuator in series to a common hydraulic pump to drive these actuators by the common hydraulic pump. The hydraulic drive apparatus includes: a hydraulic pump; a drive source for driving this hydraulic pump to make the hydraulic pump discharge hydraulic fluid; a first hydraulic actuator which includes an inlet port and an outlet port and is operated to move the load in the lowering direction by receiving the supply of the hydraulic fluid discharged from the hydraulic pump through the inlet port and discharging the hydraulic fluid through the outlet port; a first hydraulic circuit including a meter-in flow passage for introducing the hydraulic fluid to the inlet port of the first hydraulic actuator from the hydraulic pump in moving the load in the lowering direction and a meter-out flow passage for leading the hydraulic fluid discharged from the outlet port of the first hydraulic actuator to a downstream side in moving the load in the lowering direction; a control valve which is operated to change a supply state of the hydraulic fluid from the hydraulic pump to the first hydraulic actuator; an operating device for operating the control valve; a meter-in-flow-rate controller for controlling a meter-in flow rate which is a flow rate of the hydraulic fluid in the meter-in flow passage; a meter-out-flow-rate controller for controlling a meter-out flow rate, which is a flow rate of the hydraulic fluid in the meter-out flow passage, so as to make the meter-out flow rate not lower than the meter-in flow rate controlled by the meter-in-flow-rate controller; a second hydraulic actuator different from the first hydraulic actuator; a second hydraulic circuit interposed between the first hydraulic circuit and a tank to introduce the hydraulic fluid flowed in the first hydraulic circuit to the second hydraulic actuator to drive the second hydraulic actuator and lead the hydraulic fluid discharged from the second hydraulic actuator to the tank; a back pressure valve provided between the second hydraulic circuit and the tank to generate a set back pressure; a regeneration line branched off from a flow passage between the second hydraulic circuit and the back pressure valve and arranged to introduce a part of the hydraulic fluid flowed to the back pressure valve to the meter-in flow passage; and a check valve provided in the regeneration line to limit a direction of the flow of the hydraulic fluid in the regeneration line to a direction from a position downstream of the second hydraulic circuit to the meter-in flow passage.

In this hydraulic drive device, during lowering drive to move the suspended load in the same direction as the self-weight falling direction, the hydraulic fluid is flowed into the meter-in flow passage through the regeneration line from a branching point upstream of the back pressure valve under the condition where the pressure upstream of the back pressure valve is maintained at a pressure not lower than the set pressure of the back pressure valve. This makes the minimum pressure in the meter-in flow passage be not lower than the back pressure, thus effectively suppressing cavitation in the meter-in flow passage. In addition, the meter-in-flow-rate controller and the meter-out-flow-rate controller control the meter-in flow rate and the meter-out flow rate so as to make the meter-out flow rate not lower than the meter-in flow rate, thereby securing the flow of the hydraulic fluid from the meter-out flow passage to the meter-in flow passage through the regeneration line, that is, enabling a regeneration flow rate to be ensured.

The meter-out-flow-rate controller, including a meter-out orifice and a meter-out-flow-rate regulating valve which varies the meter-out flow rate to make a differential pressure across the meter-out orifice be a preset pressure and having a measurement point and a control point both of which are located in the meter-out flow passage, has a co-location in control theory differently from a conventional counter balance valve whose measurement point is located in a meter-in flow passage while whose control point is located in a meter-out flow passage. Hence, hunting in the valve opening degree and pressure of the meter-out-flow-rate regulating valve is effectively suppressed. That is, this hydraulic drive device is capable of suppressing cavitation in the meter-in flow passage with no use of a valve prone to hunting in valve opening degree and pressure, resulting in effective suppression of hunting in the driving speed of the hydraulic actuator.

Furthermore, in this hydraulic drive device, the second hydraulic circuit interposed between the meter-out flow passage and the tank leads the hydraulic fluid flowed in the meter-out flow passage to the second hydraulic actuator and leads the hydraulic fluid discharged from the second hydraulic actuator to the tank, thereby enabling the hydraulic pump to commonly drive both of the first and second hydraulic actuators. In addition, the regeneration line, which returns not the hydraulic fluid flowed in the meter-out flow passage but the hydraulic fluid flowed in the second hydraulic circuit before reaching the back pressure valve to the meter-in flow passage, can supply regenerated fluid having a stable pressure regardless of the load of the second hydraulic actuator to the meter-in flow passage.

If, differently from the invention, the regeneration line was branched off not from the side downstream of the second hydraulic circuit but from the meter-out flow passage upstream of the second hydraulic circuit to supply the hydraulic fluid as the regenerated fluid to the meter-in flow passage, the pressure of the regenerated fluid would include not only the set pressure of the back pressure valve but also include the differential pressure across the second hydraulic actuator equivalent to the load of the second hydraulic actuator to the set pressure; therefore, the regenerated fluid having a high pressure could be supplied to the meter-in flow passage, depending on the load of the second hydraulic actuator, to thereby drastically increase a meter-in pressure which is a pressure in the meter-in flow passage.

Furthermore, when the first hydraulic actuator is driven to move the load in the lowering direction, the pressure in the meter-out flow passage, namely, the meter-out pressure, would be a pressure obtained by adding the pressure corresponding to the load to the meter-in pressure, thus being excessively increased to adversely affect the pipes and various components constituting the meter-out flow passage. In other words, there could be cases where the load of the second hydraulic actuator has to be significantly limited to avoid such an excessive increase in the meter-out pressure.

Contrary to this, the regeneration line according to the present invention, which introduces the hydraulic fluid flowed in the flow passage downstream of the second hydraulic circuit and upstream of the back pressure valve to the meter-in flow passage as regenerated fluid, allows the pressure of the regenerated fluid to be stable regardless of the load of the second hydraulic actuator connected to the second hydraulic circuit, thus stabilizing also the meter-in pressure and the meter-out pressure downstream thereof, which are affected by the pressure of the regenerated fluid. This enables the lowering drive of the first hydraulic actuator, i.e., the drive of the first hydraulic actuator to move the load in the lowering direction, to be stably performed regardless of the series arrangement of the first and second hydraulic actuators.

In the present invention, specific configuration and usage of the second hydraulic actuator and specific configuration of the second hydraulic circuit for driving the second hydraulic actuator do not matter. For example, the second hydraulic actuator may be one for moving a load in the lowering direction like the first hydraulic actuator (e.g. hydraulic winch). In that case, it is preferable that: the second hydraulic circuit includes a meter-in flow passage and a meter-out flow passage like the first hydraulic circuit; a meter-in-flow-rate controller and a meter-out-flow-rate controller are provided for the meter-in flow passage and the meter-out flow passage to control a meter-in flow rate and a meter-out flow rate, respectively, so as to make the meter-out flow rate be higher than the meter-in flow rate; and the hydraulic fluid corresponding to a difference between the meter-out and meter-in flow rates is returned from the meter-out flow passage to the meter-in flow passage. These allow the above effects about driving the first hydraulic actuator to be similarly obtained also about driving the second hydraulic actuator. Thus, the present invention can also provide a device including: a hydraulic pump; a drive source for driving the hydraulic pump to make the hydraulic pump discharge hydraulic fluid; a first hydraulic actuator which includes a first inlet port and a first outlet port and is operated to move the first load in the lowering direction by receiving a supply of the hydraulic fluid discharged from the hydraulic pump through the first inlet port and discharging the hydraulic fluid through the first outlet port; a first hydraulic circuit including a first meter-in flow passage for introducing the hydraulic fluid to the first inlet port of the first hydraulic actuator from the hydraulic pump in moving the first load in the lowering direction and a first meter-out flow passage for leading the hydraulic fluid discharged from the first outlet port of the first hydraulic actuator to a downstream side in moving the first load in the lowering direction; a first control valve which is operated to change a supply state of the hydraulic fluid from the hydraulic pump to the first hydraulic actuator; a first operating device for operating the first control valve; a first meter-in-flow-rate controller for controlling a first meter-in flow rate which is a flow rate of the hydraulic fluid in the first meter-in flow passage; a first meter-out-flow-rate controller for controlling a first meter-out flow rate, which is a flow rate of the hydraulic fluid in the first meter-out flow passage, so as to make the first meter-out flow rate not lower than the first meter-in flow rate controlled by the meter-in-flow-rate controller; a second hydraulic actuator other than the first hydraulic actuator, the second hydraulic actuator including a second inlet port and a second outlet port and being operated to move the second load in the lowering direction by receiving a supply of the hydraulic fluid discharged from the hydraulic pump through the second inlet port and discharging the hydraulic fluid through the second outlet port; a second hydraulic circuit including a second meter-in flow passage for introducing the hydraulic fluid having been flowed in the first hydraulic circuit to the second inlet port of the second hydraulic actuator in moving the second load in the lowering direction and a second meter-out flow passage for leading the hydraulic fluid discharged from the second outlet port of the second hydraulic actuator to a tank in moving the second load in the lowering direction; a second control valve which is operated to change a supply state of the hydraulic fluid from the hydraulic pump to the second hydraulic actuator; a second operating device for operating the second control valve; a second meter-in-flow-rate controller for controlling a second meter-in flow rate which is a flow rate of the hydraulic fluid in the second meter-in flow passage; a second meter-out-flow-rate controller for controlling a second meter-out flow rate, which is a flow rate of the hydraulic fluid in the second meter-out flow passage, so as to make the second meter-out flow rate not lower than the second meter-in flow rate controlled by the meter-in-flow-rate controller; a back pressure valve provided between the second hydraulic circuit and the tank to generate a set back pressure; a regeneration line branched off from a flow passage between the second hydraulic circuit and the back pressure valve and arranged to lead a part of the hydraulic fluid flowed to the back pressure valve to the first and second meter-in flow passages; and a check valve provided in the regeneration line to limit a direction of the flow of the hydraulic fluid in the regeneration line to a direction from a position downstream of the second hydraulic circuit to the first and second meter-in flow passages.

This application is based on Japanese Patent application No. 2012-249063 filed in Japan Patent Office on Nov. 13, 2012, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A hydraulic drive device for work machine for hydraulically moving a load in a lowering direction, which is the same direction as a falling direction of the load by the own weight of the load, comprising:

a hydraulic pump;

a drive source for driving the hydraulic pump to make the hydraulic pump discharge hydraulic fluid;

a first hydraulic actuator which includes an inlet port and an outlet port and is operated to move the load in the lowering direction by receiving a supply of the hydraulic fluid discharged from the hydraulic pump through the inlet port and discharging the hydraulic fluid through the outlet port;

a first hydraulic circuit including a meter-in flow passage for introducing the hydraulic fluid discharged from the hydraulic pump to the inlet port of the first hydraulic actuator in moving the load in the lowering direction and a meter-out flow passage for leading the hydraulic fluid discharged from the outlet port of the first hydraulic actuator to a downstream side in moving the load in the lowering direction;

a control valve which is operated to change a supply state of the hydraulic fluid from the hydraulic pump to the first hydraulic actuator;

an operating device for operating the control valve;

a meter-in-flow-rate control circuit for controlling a meter-in flow rate which is a flow rate of the hydraulic fluid in the meter-in flow passage;

a meter-out-flow-rate control circuit for controlling a meter-out flow rate, which is a flow rate of the hydraulic fluid in the meter-out flow passage, so as to make the meter-out flow rate not lower than the meter-in flow rate controlled by the meter-in-flow-rate control circuit;

a second hydraulic actuator other than the first hydraulic actuator;

a second hydraulic circuit interposed between the first hydraulic circuit and a tank to introduce the hydraulic fluid, which has been discharged from the first hydraulic actuator and has flowed in the first hydraulic circuit to the second hydraulic actuator to drive the second hydraulic actuator and lead the hydraulic fluid discharged from the second hydraulic actuator to the tank;

a connection line interconnecting the first hydraulic circuit and the second hydraulic circuit to introduce the hydraulic fluid having flowed in the first hydraulic circuit into the second hydraulic circuit;

a tank line separated from the connection line, the tank line connecting the second hydraulic circuit to the tank to return the hydraulic fluid from the second hydraulic circuit to the tank;

a back pressure valve provided in the tank line and located between the second hydraulic circuit and the tank, the back pressure valve being a valve which is given a set pressure and generates a back pressure equivalent to the set pressure downstream of the second hydraulic circuit and upstream of the back pressure valve;

a regeneration line branched off from a flow passage of the tank line, the flow passage being located between the second hydraulic circuit and the back pressure valve, the regeneration line being arranged to lead a part of the hydraulic fluid, which has flowed from the second hydraulic circuit to the back pressure valve, to the meter-in flow passage; and a check valve provided in the regeneration line to limit a direction of the flow of the hydraulic fluid in the regeneration line to a direction from a position downstream of the second hydraulic circuit to the meter-in flow passage.

2. A hydraulic drive device for work machine for hydraulically moving a first load and a second load in a lowering direction, which is the same direction as a falling direction of the loads by the own weight of the loads, comprising:

a hydraulic pump;

a drive source for driving the hydraulic pump to make the hydraulic pump discharge hydraulic fluid;

a first hydraulic actuator which includes a first inlet port and a first outlet port and is operated to move the first load in the lowering direction by receiving a supply of the hydraulic fluid discharged from the hydraulic pump through the first inlet port and discharging the hydraulic fluid through the first outlet port;

a first hydraulic circuit including a first meter-in flow passage for introducing the hydraulic fluid discharged from the hydraulic pump to the first inlet port of the first hydraulic actuator in moving the first load in the lowering direction and a first meter-out flow passage for leading the hydraulic fluid discharged from the first outlet port of the first hydraulic actuator to a downstream side in moving the first load in the lowering direction;

a first control valve which is operated to change a supply state of the hydraulic fluid from the hydraulic pump to the first hydraulic actuator;

a first operating device for operating the first control valve;

a first meter-in-flow-rate control circuit for controlling a first meter-in flow rate which is a flow rate of the hydraulic fluid in the first meter-in flow passage;

a first meter-out-flow-rate control circuit for controlling a first meter-out flow rate, which is a flow rate of the hydraulic fluid in the first meter-out flow passage, so as to make the first meter-out flow rate not lower than the first meter-in flow rate controlled by the meter-in-flow-rate control circuit;

a second hydraulic actuator other than the first hydraulic actuator, the second hydraulic actuator including a second inlet port and a second outlet port and being operated to move the second load in the lowering direction by receiving a supply of the hydraulic fluid discharged from the hydraulic pump through the second inlet port and discharging the hydraulic fluid through the second outlet port;

a second hydraulic circuit including a second meter-in flow passage for introducing the hydraulic fluid, which has been discharged from the first hydraulic actuator and has flowed in the first hydraulic circuit to the second inlet port of the second hydraulic actuator in moving the second load in the lowering direction and a second meter-out flow passage for leading the hydraulic fluid discharged from the second outlet port of the second hydraulic actuator to a tank in moving the second load in the lowering direction;

a second control valve which is operated to change a supply state of the hydraulic fluid from the hydraulic pump to the second hydraulic actuator;

a second operating device for operating the second control valve;

a second meter-in-flow-rate control circuit for controlling a second meter-in flow rate which is a flow rate of the hydraulic fluid in the second meter-in flow passage;

a second meter-out-flow-rate control circuit for controlling a second meter-out flow rate, which is a flow rate of the hydraulic fluid in the second meter-out flow passage, so as to make the second meter-out flow rate not lower than the second meter-in flow rate controlled by the meter-in-flow-rate control circuit;

a connection line interconnecting the first hydraulic circuit and the second hydraulic circuit to introduce the hydraulic fluid having flowed in the first hydraulic circuit into the second hydraulic circuit;

a tank line separated from the connection line, the tank line connecting the second hydraulic circuit to the tank to return the hydraulic fluid from the second hydraulic circuit to the tank;

a back pressure valve provided in the tank line and located between the second hydraulic circuit and the tank, the back pressure valve being a valve which is given a set pressure and generates a back pressure equivalent to the set pressure downstream of the second hydraulic circuit and upstream of the back pressure valve;

a regeneration line branched off from a flow passage of the tank line, the flow passage being located between the second hydraulic circuit and the back pressure valve, the regeneration line being arranged to lead a part of the hydraulic fluid, which has flowed from the second hydraulic circuit to the back pressure valve, to the first and second meter-in flow passages; and a check valve provided in the regeneration line to limit a direction of the flow of the hydraulic fluid in the regeneration line to a direction from a position downstream of the second hydraulic circuit to the first and second meter-in flow passages.

3. A hydraulic drive device for work machine according to claim 1, wherein:

the control valve which is a pilot-controlled selector valve including a lowering pilot port and a hoisting pilot port, either of which receives a supply of a hydraulic pilot pressure, the pilot-controlled selector valve being configured to be operated to change the supply state of the hydraulic fluid from the hydraulic pump to the first hydraulic actuator according to the hydraulic pressure supplied to either of the lowering pilot port and the hoisting pilot port; and the operating device supplies the hydraulic pilot pressure to the lowering pilot port or the hoisting pilot port, according to an operation applied to the operating device, for operating the control valve.

4. A hydraulic drive device for work machine according to claim 2, wherein:

the first control valve which is a pilot-controlled selector valve including a lowering pilot port and a hoisting pilot port, either of which receives a supply of a hydraulic pilot pressure, the pilot-controlled selector valve being configured to be operated to change the supply state of the hydraulic fluid from the hydraulic pump to the first hydraulic actuator according to the hydraulic pressure supplied to either of the lowering pilot port and the hoisting pilot port; and the operating device supplies the hydraulic pilot pressure to the lowering pilot port or the hoisting pilot port, according to an operation applied to the operating device, for operating the control valve.

* * * * *